US010973335B2

(12) United States Patent
Kanthasamy

(10) Patent No.: US 10,973,335 B2
(45) Date of Patent: Apr. 13, 2021

(54) FURNITURE OBJECT INCLUDING SEALABLE ENCLOSURE FOR STORING PIECE OF SEPARATE FURNITURE OBJECT

(71) Applicant: Abedan Kanthasamy, Mississauga (CA)

(72) Inventor: Abedan Kanthasamy, Mississauga (CA)

( * ) Notice: Subject to any disclaimer, the term of this patent is extended or adjusted under 35 U.S.C. 154(b) by 105 days.

(21) Appl. No.: 16/184,205

(22) Filed: Nov. 8, 2018

(65) Prior Publication Data

US 2020/0146458 A1 May 14, 2020

(51) Int. Cl.

| | |
|---|---|
| ***A47C 7/62*** | (2006.01) |
| ***A47C 16/02*** | (2006.01) |
| ***A47C 17/16*** | (2006.01) |
| ***A47C 17/37*** | (2006.01) |
| ***A47C 19/22*** | (2006.01) |
| ***A47B 85/04*** | (2006.01) |

(52) U.S. Cl.

CPC ..... *A47C 17/37* (2013.01); *A47B 85/04* (2013.01); *A47C 7/628* (2018.08); *A47C 16/02* (2013.01); *A47C 17/16* (2013.01); *A47C 19/22* (2013.01)

(58) Field of Classification Search

CPC ..... A47C 4/028; A47C 7/626; A47C 7/628; A47C 13/005; A47C 16/02; A47C 17/16; A47C 17/37; A47C 17/86

See application file for complete search history.

(56) References Cited

U.S. PATENT DOCUMENTS

| | | | | |
|---|---|---|---|---|
| 5,575,535 | A * | 11/1996 | Burchett | A47C 17/045 297/146 |
| 8,356,954 | B2 * | 1/2013 | Koch | A47C 17/02 403/353 |
| 9,480,338 | B2 * | 11/2016 | Griggs, Jr. | A47C 17/00 |
| 10,362,880 | B2 * | 7/2019 | Oh | A47C 23/06 |
| 2011/0101763 | A1 * | 5/2011 | Chen | A47C 17/02 297/440.15 |

(Continued)

FOREIGN PATENT DOCUMENTS

| | | | | |
|---|---|---|---|---|
| CA | 2773026 | A1 * | 9/2012 | A47C 17/86 |
| CA | 2862908 | A1 * | 8/2013 | A47C 17/04 |
| CN | 203314506 | U * | 12/2013 | |

*Primary Examiner* — Ryan D Kwiecinski

(74) *Attorney, Agent, or Firm* — Harness, Dickey & Pierce, P.L.C.

(57) ABSTRACT

A furniture object includes a load-bearing support assembly, a seating assembly, and a seal assembly. The load-bearing support assembly may support a structural load. The load-bearing support assembly includes a plurality of load-bearing beams. The seating assembly may receive the structural load such that the seating assembly conducts the structural load to the load-bearing support assembly. The seal assembly includes a partition structure configured to define a sealable aperture into an interior of the furniture object. The load-bearing beams, the seating assembly, and the seal assembly collectively define a sealable enclosure within an interior of the furniture object, such that the furniture object may hold a plurality of separate pieces of a separate furniture object within the enclosure, and the partition structure may detach from a remainder structure of the seal assembly to enable removal of the plurality of separate pieces from the enclosure through the opened aperture.

28 Claims, 23 Drawing Sheets

(56) References Cited

U.S. PATENT DOCUMENTS

| | | | | |
|---|---|---|---|---|
| 2012/0217784 | A1* | 8/2012 | Griggs, Jr. | A47C 4/08 297/440.1 |
| 2012/0248836 | A1* | 10/2012 | Lejcher | A47C 17/02 297/232 |
| 2017/0071354 | A1* | 3/2017 | Mezzera | A47C 13/005 |
| 2017/0112286 | A1* | 4/2017 | Griggs, Jr. | A47C 7/021 |

* cited by examiner

FURNITURE OBJECT INCLUDING SEALABLE ENCLOSURE FOR STORING PIECE OF SEPARATE FURNITURE OBJECT

FIELD

The present disclosure relates generally to furniture objects, and more particularly to furniture sets ("furniture assemblies") including multiple separate furniture objects.

BACKGROUND

Furniture is often used in environments (e.g., residential, commercial, industrial, etc.) to support or otherwise aid in various human activities, such as seating, eating, sleeping, storage, and the like. To this end, furniture may include multiple furniture objects, referred to herein as a "furniture set," that collectively support or otherwise aid in one or more human activities. Such support or aid is generally referred to herein as providing "utility" to a human engaging ("interacting") with the furniture objects of the furniture set. A human interacting with one or more furniture objects may be referred to herein as a "user."

As an example of a furniture set including multiple furniture objects that collectively provide utility to a user, a sofa furniture set may include a first furniture object that is a sofa and a second furniture object that is an ottoman, where the sofa and the ottoman may collectively provide utility to a user seated on the sofa (e.g., to rest the user's legs on the ottoman). In another example, a sofa furniture set may include a first furniture object that is a sofa and a second furniture object that is a table, where the sofa and the table may collectively provide utility to a user seated on the sofa (e.g., to rest objects on the table for use and/or ease of access by the user that is seated on the sofa).

In some cases, the various furniture objects of a furniture set may be manufactured in one or more locations and transported over significant distances to a merchant and/or end-user of the furniture set.

SUMMARY

According to some example embodiments, a furniture set may include a first furniture object and a second furniture object. The first furniture object may include a load-bearing support assembly, a seating assembly on the load-bearing support assembly, and a seal assembly on the load-bearing support assembly. The load-bearing support assembly may be configured to support a structural load. The load-bearing support assembly may include a plurality of load-bearing beams. The seating assembly may be configured to receive the structural load such that the seating assembly conducts the structural load to the load-bearing support assembly. The seal assembly may include a partition structure configured to define a sealable aperture into an interior of the furniture object. The second furniture object may include one or more separate pieces. The second furniture object may include a plurality of separate pieces that may be configured to be detachably coupled to each other to assemble the second furniture object. The load-bearing beams, the seating assembly, and the seal assembly may collectively define a sealable enclosure within an interior of the first furniture object, such that the furniture object is configured to hold the one or more separate pieces within the enclosure, and the partition structure is configured to detach from a remainder structure of the seal assembly to open the aperture to enable removal of the one or more separate pieces from the enclosure through the opened aperture.

The load-bearing beams may define side boundaries of the enclosure. The seating assembly may define a top boundary of the enclosure. The seal assembly may define a bottom boundary of the enclosure.

The first furniture object may be a convertible sofa.

The second furniture object may be an ottoman.

The one or more separate pieces may be a plurality of separate pieces that are configured to be coupled together in different configurations to assemble the second furniture object.

The plurality of load-bearing beams, the seating assembly, and the seal assembly may collectively define a plurality of enclosures within the interior of the first furniture object. The plurality of enclosures may be isolated from each other by at least one load-bearing beam of the plurality of load-bearing beams, such that the first furniture object is configured to hold a plurality of separate pieces within separate, respective enclosures of the plurality of enclosures, the plurality of enclosures including the enclosure.

The partition structure may be configured to expose the plurality of enclosures based on detaching from the remainder structure of the seal assembly.

Each enclosure of the plurality of enclosures may have a size that substantially matches a volume of a separate piece of a plurality of separate pieces, such that each separate piece occupies substantially an entirety of a separate enclosure of the plurality of enclosures.

The partition structure may be configured to reversibly detach from the remainder structure to reversibly open the aperture.

The seal assembly may include a fastener assembly that is configured to reversibly detach the partition structure from the remainder structure.

According to some example embodiments, a furniture object may include a load-bearing support assembly, a seating assembly on the load-bearing support assembly, and a seal assembly on the load-bearing support assembly. The load-bearing support assembly may be configured to support a structural load. The load-bearing support assembly may include a plurality of load-bearing beams. The seating assembly may be configured to receive the structural load such that the seating assembly conducts the structural load to the load-bearing support assembly. The seal assembly may include a partition structure configured to define a sealable aperture into an interior of the furniture object. The load-bearing beams, the seating assembly, and the seal assembly may collectively define a sealable enclosure within an interior of the furniture object, such that the furniture object is configured to hold one or more separate pieces of a separate furniture object within the enclosure, and the partition structure is configured to detach from a remainder structure of the seal assembly to open the aperture to enable removal of the one or more separate pieces from the enclosure through the opened aperture.

The load-bearing beams may define side boundaries of the enclosure. The seating assembly may define a top boundary of the enclosure. The seal assembly may define a bottom boundary of the enclosure.

The furniture object may be a convertible sofa.

The separate furniture object may be an ottoman.

The plurality of load-bearing beams, the seating assembly, and the seal assembly collectively define a plurality of enclosures within the interior of the furniture object. The plurality of enclosures may be isolated from each other by at least one load-bearing beam of the plurality of load-bearing beams, such that the furniture object is configured to hold a plurality of separate pieces within separate, respective enclosures of the plurality of enclosures, the plurality of enclosures including the enclosure.

The partition structure may be configured to expose the plurality of enclosures based on detaching from the remainder structure of the seal assembly.

Each enclosure of the plurality of enclosures may have a size that substantially matches a volume of a separate piece of the plurality of separate pieces, such that each separate piece occupies substantially an entirety of a separate enclosure of the plurality of enclosures.

The partition structure may be configured to reversibly detach from the remainder structure to reversibly open the aperture.

The seal assembly may include a fastener assembly that is configured to reversibly detach the partition structure from the remainder structure.

According to some example embodiments, a method may include providing a first furniture object, the first furniture object including a load-bearing support assembly, the load-bearing support assembly configured to support a structural load, the load-bearing support assembly including a plurality of load-bearing beams; a seating assembly on the load-bearing support assembly, the seating assembly configured to receive the structural load such that the seating assembly conducts the structural load to the load-bearing support assembly; and a seal assembly on the load-bearing support assembly, the seal assembly including a partition structure configured to define a sealable aperture into an interior of the furniture object, wherein the load-bearing beams, the seating assembly, and the seal assembly collectively define a sealable enclosure within an interior of the furniture object, where one or more separate pieces of a second furniture object are located within the enclosure. The method may further include detaching the partition structure from a remainder structure of the seal assembly to open the aperture to expose the enclosure to an exterior of the first furniture object, removing the one or more separate pieces from the enclosure via the opened aperture. Where the one or more separate pieces include a plurality of separate pieces, the method may further include coupling the plurality of separate pieces together to assemble the second furniture object.

The load-bearing beams may define side boundaries of the enclosure. The seating assembly may define a top boundary of the enclosure. The seal assembly may define a bottom boundary of the enclosure.

The first furniture object may be a convertible sofa.

The second furniture object may be an ottoman.

Where the one or more separate pieces include a plurality of separate pieces, the plurality of separate pieces may be configured to be assembled in different configurations to assemble the second furniture object.

The plurality of load-bearing beams, the seating assembly, and the seal assembly may collectively define a plurality of enclosures within the interior of the furniture object. The plurality of enclosures may be isolated from each other by at least one load-bearing beam of the plurality of load-bearing beams, such that a plurality of separate pieces may be isolated from each other and held within separate, respective enclosures of the plurality of enclosures, the plurality of enclosures including the enclosure.

The partition structure may be configured to expose the plurality of enclosures based on detaching from the remainder structure of the seal assembly.

Each enclosure of the plurality of enclosures may have a size that substantially matches a volume of a separate piece of the plurality of separate pieces, such that each separate piece of the one or more pieces may occupy substantially an entirety of a separate enclosure of the plurality of enclosures.

The detaching the partition structure from the remainder structure of the seal assembly may include reversibly detaching the partition structure from the remainder structure to reversibly open the aperture.

The seal assembly may include a fastener assembly that is configured to reversibly detach the partition structure from the remainder structure.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1:
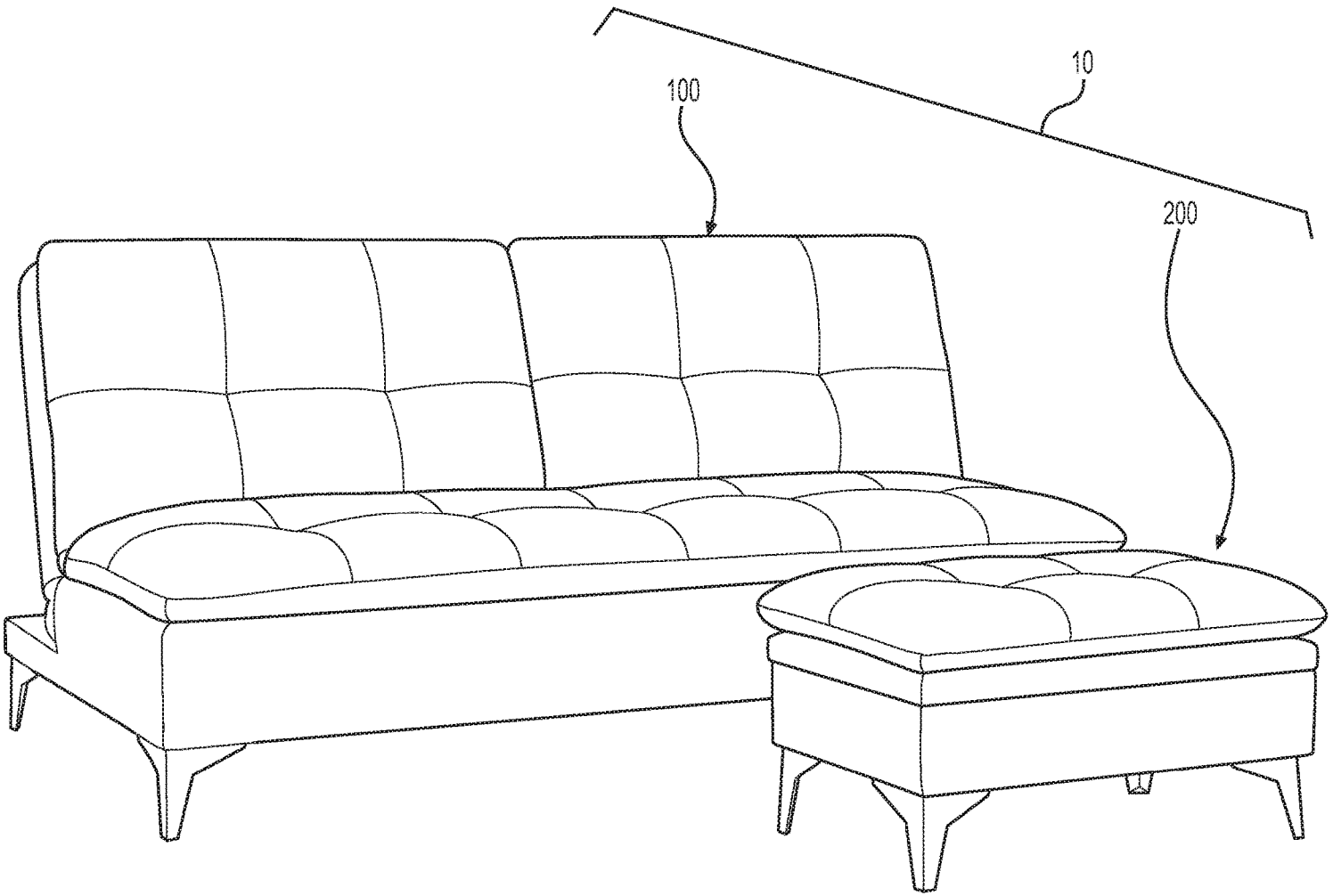
FIG. 1 is a perspective view of a furniture set including a first furniture object and an assembled second furniture object, according to some example embodiments.
Figure 2A:
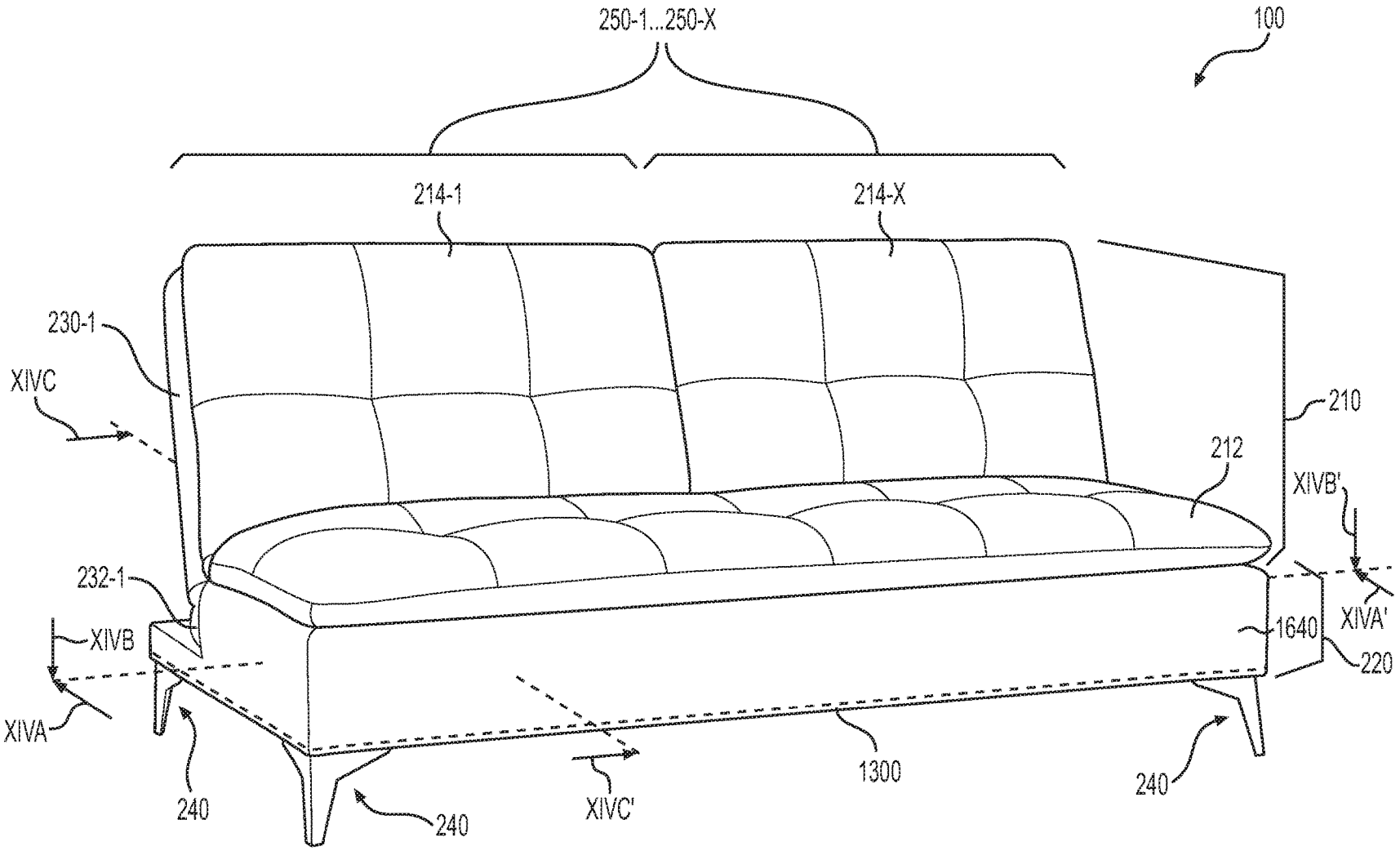
FIGS. 2A, 2B, 2C, and 2D are perspective views of the first furniture object shown in FIG. 1, according to some example embodiments.
Figure 2B:
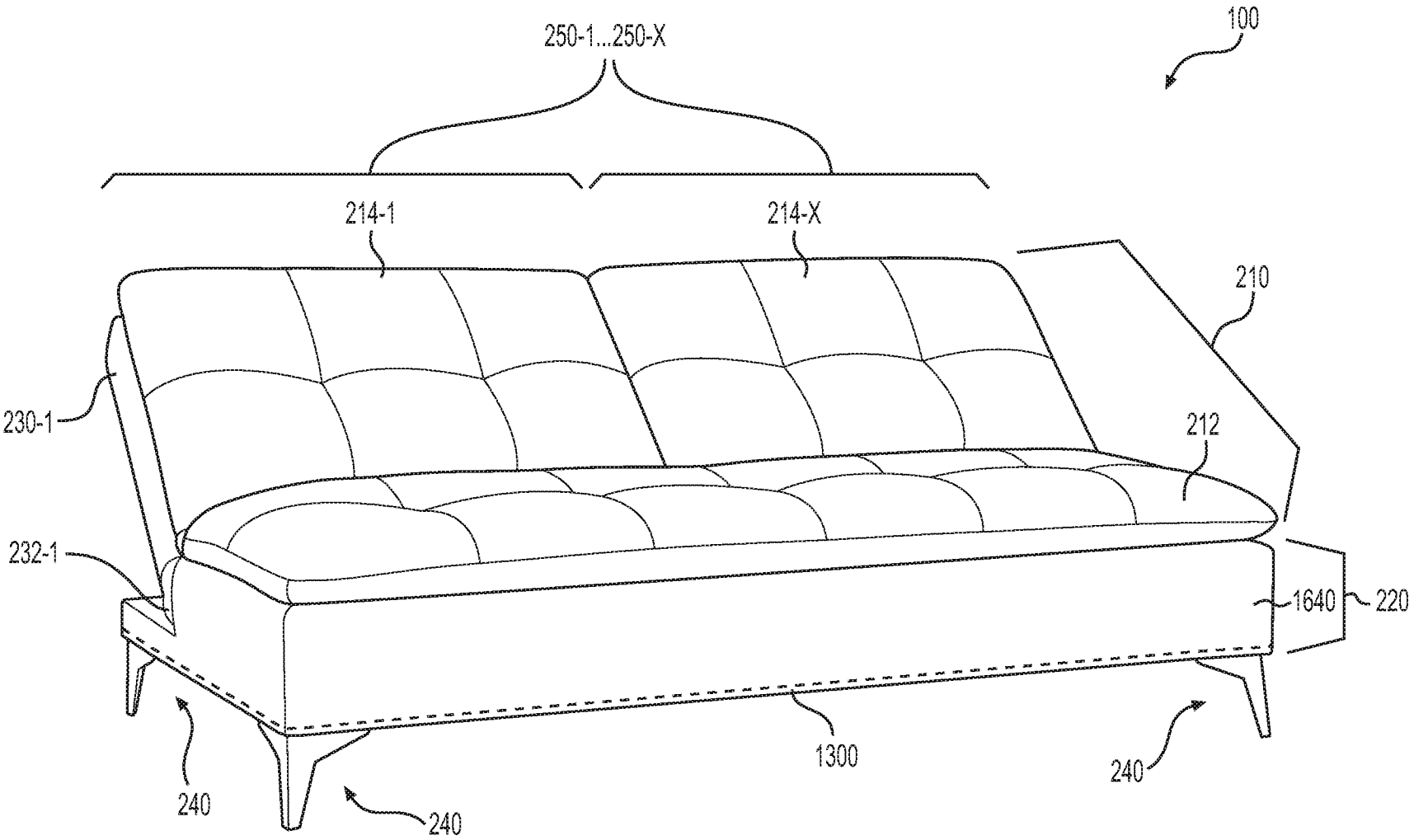
Figure 2C:
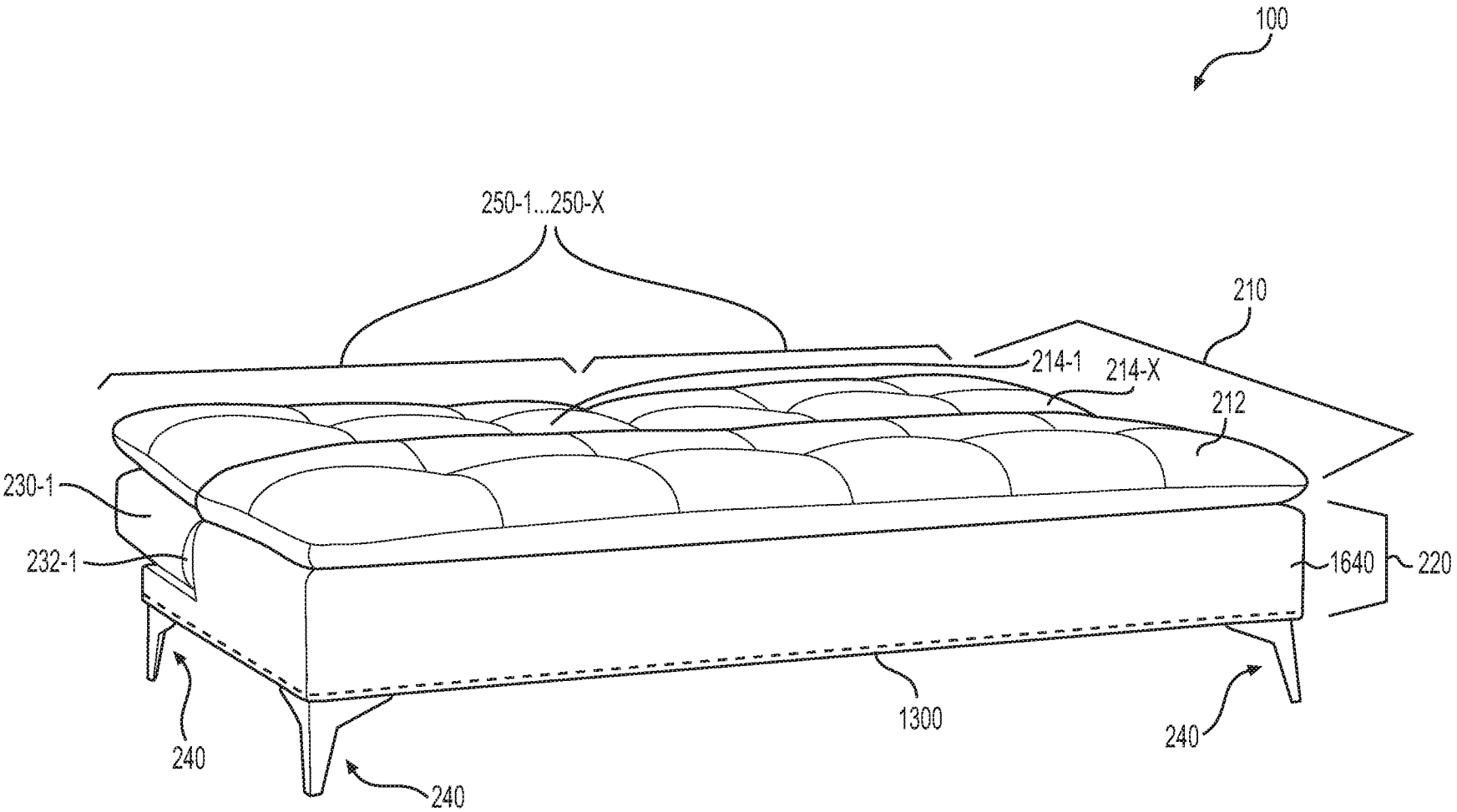
Figure 2D:
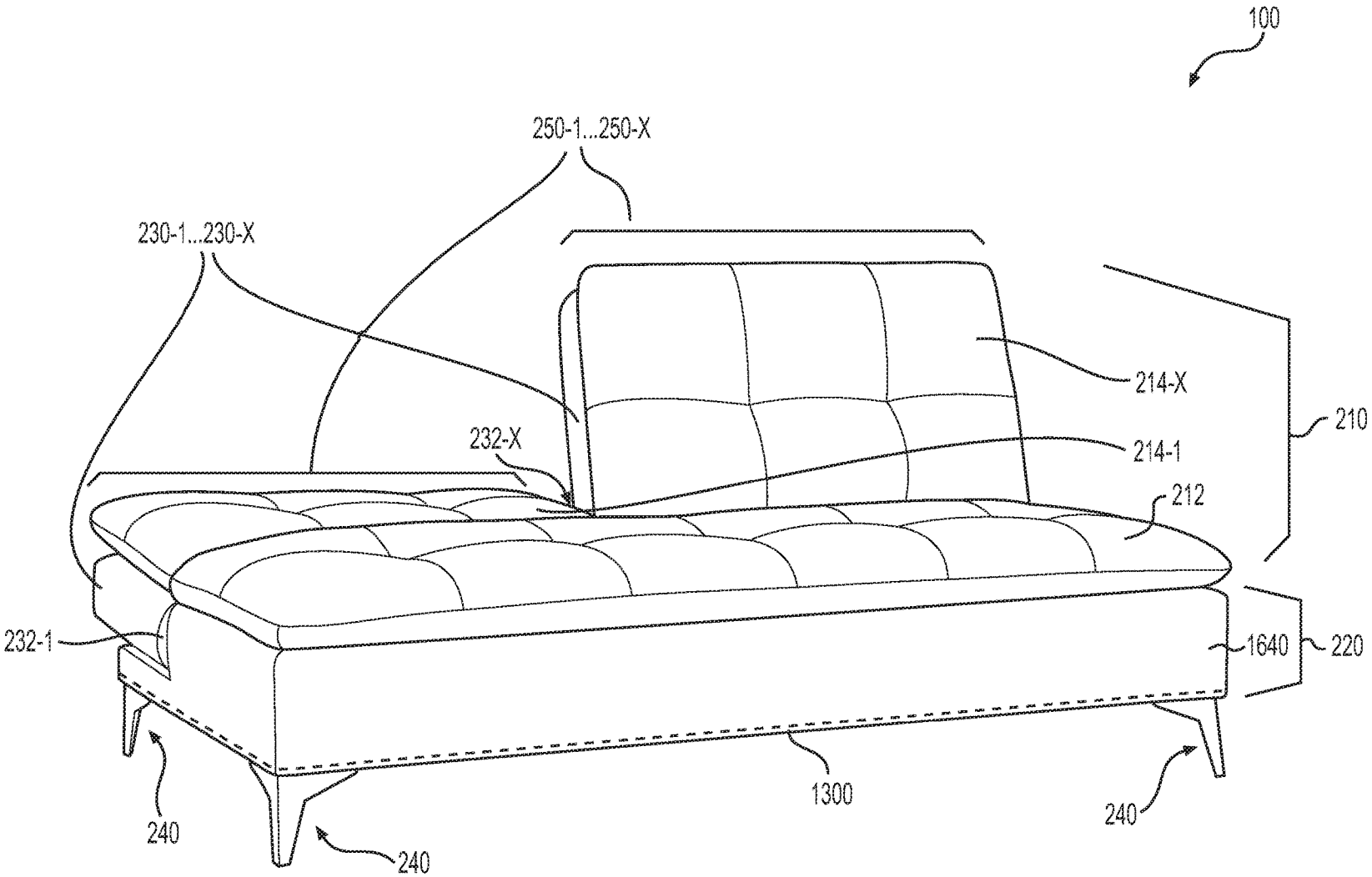

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," "attached to," "adjacent to," or "covering" another element or layer, it may be directly on, connected to, coupled to, attached to, adjacent to or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

When the words "about" and "substantially" are used in this specification in connection with a numerical value, it is intended that the associated numerical value include a tolerance of ±10% around the stated numerical value, unless otherwise explicitly defined.

Example embodiments are described herein with reference to cross-sectional illustrations that are schematic illustrations of example embodiments. As such, variations from the shapes of the illustrations are to be expected. Thus, example embodiments should not be construed as limited to the shapes of regions illustrated herein but are to include deviations in shapes.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is a perspective view of a furniture set 10 including a first furniture object 100 and an assembled second furniture object 200, according to some example embodiments.

In some example embodiments, a furniture set 10 includes multiple furniture objects that collectively provide utility to a user (e.g., support or otherwise aid in one or more human activities associated with and/or engaged in by the user). As referred to herein, an individual "furniture object" will be understood to be an instance of "furniture," as the term is commonly understood (e.g., a movable object configured to support and/or aid one or more various human activities, including seating (e.g., chairs, stools, and sofas), eating (tables), storing (cabinets), and sleeping (e.g., beds)). A furniture object configured to support a structural load of a user (e.g., a sofa) may be distinguished from a cushioning object (e.g., a pillow) on which a user may apply at least some of said structural load, in that such a furniture object configured to support a structural load includes a load-bearing support assembly that is configured to support (e.g., "bear") the structural load (e.g., conduct the structural load through the load-bearing support assembly to an external foundation (e.g., a floor upon which the furniture object rests)) without deformation of the load-bearing support assembly, while the cushioning object (e.g., pillow) is not configured to do so. A load-bearing support assembly may be referred to herein as simply a "load-bearing structure" or a "frame structure" as the term is commonly understood.

As shown in FIG. 1, a furniture set 10 may include a first furniture object 100 and a second furniture object 200 that are configured to collectively provide utility to a user. For example, in the example embodiments shown in FIG. 1, the first furniture object 100 is a convertible sofa and the second furniture object 200 is an ottoman, as the terms "convertible sofa" and "ottoman" are commonly understood, and the first and second furniture objects 100, 200 of the furniture set 10 collectively provide utility to a user (e.g., a human engaging with the furniture set 10) to enable the user to sit and/or recline on the convertible sofa (first furniture object 100) while supporting one or more of the user's limbs (e.g., legs) on the ottoman (second furniture objet 200), thereby providing improved support to the user in relation to if the user engaged with only one of the furniture objects 100, 200.

As described further below, in some example embodiments, the first furniture object 100 is configured to hold ("store") the second furniture object 200, in an assembled state or in a disassembled state (e.g., hold a plurality of separate pieces that, when coupled together, for the second furniture object 200), within one or more internal compartments ("enclosures") within an interior of the first furniture object 100. Accordingly, the entire furniture set 10 may be stored and/or transported in a volume that does not exceed the volume occupied by only the first furniture object 100, thereby simplifying and improving efficiency of storage of the furniture set 10, packaging of the furniture set 10, transport of the furniture set 10, a sub-combination thereof, or a combination thereof. In addition, based on the first furniture object 100 being configured to hold ("store") the second furniture object 200, in an assembled state or in a disassembled state, the furniture set 10 may be packaged and/or shipped as if the furniture set were a single instance of furniture: the first furniture object 100. As a result, concurrent transport of all furniture objects 100, 200 of the furniture set 10 to a common location, storage of all furniture objects 100, 200 of the furniture set 10 in a common location, a sub-combination thereof, or a combination thereof may be ensured, thereby reducing the risk of inadvertent separation and/or loss of one or more of the furniture objects of the furniture set 10 during storage and/or transport thereof.

Figure 3:
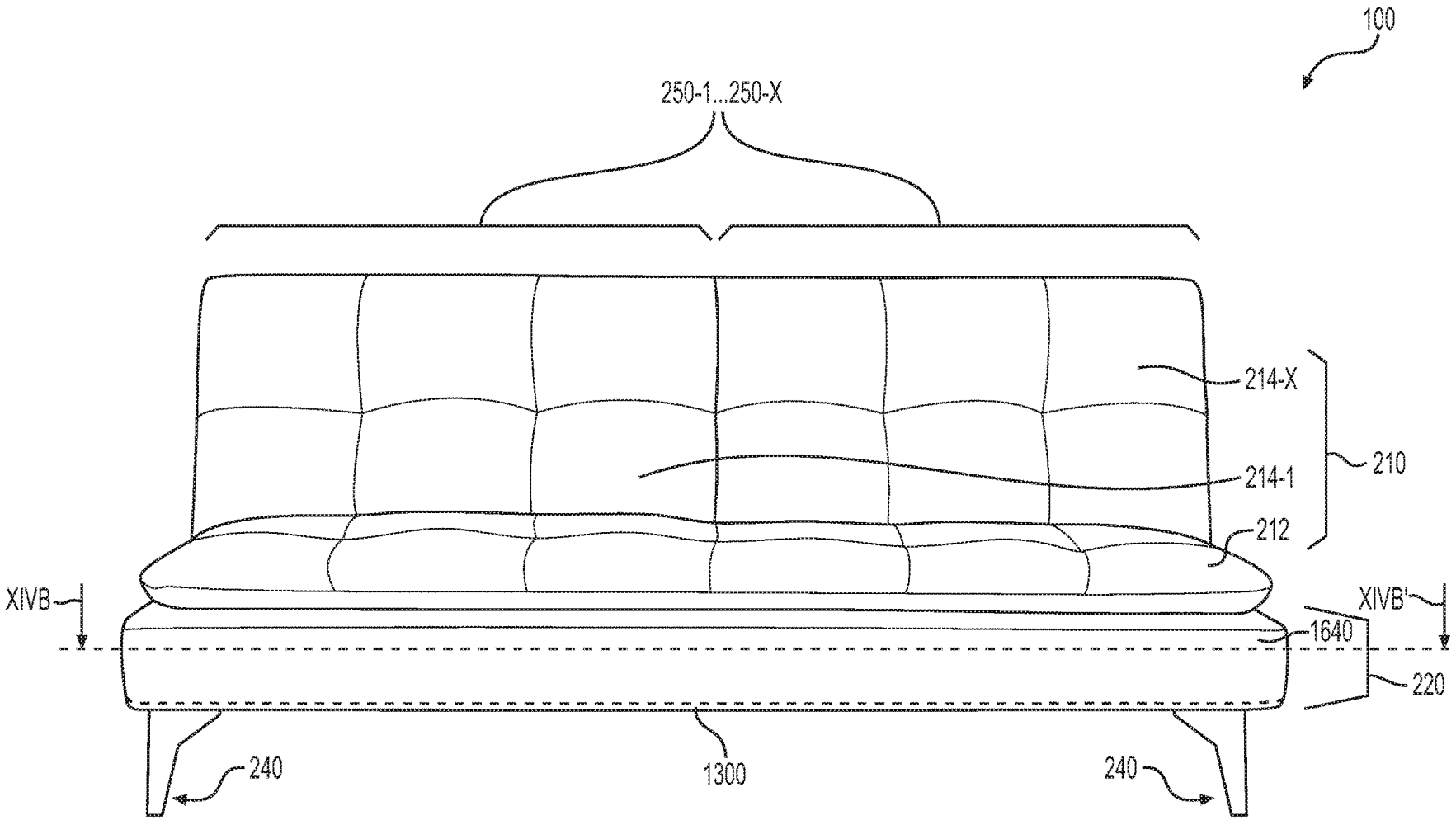
FIG. 3 is a front view of the first furniture object shown in FIG. 1, according to some example embodiments.
Figure 4A:
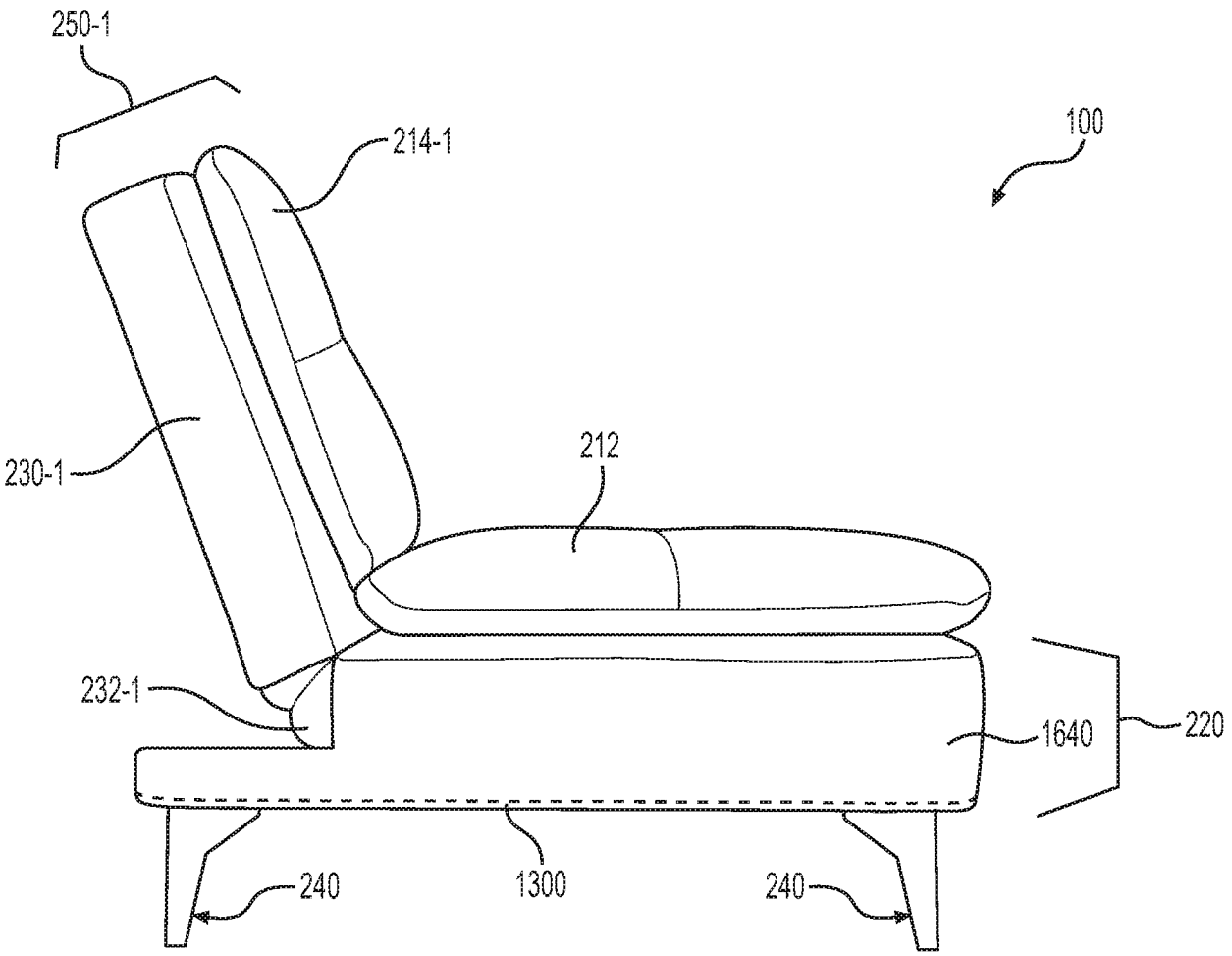
FIGS. 4A and 4B are left-side and right-side views, respectively, of the first furniture object shown in FIG. 1, according to some example embodiments.
Figure 4B:
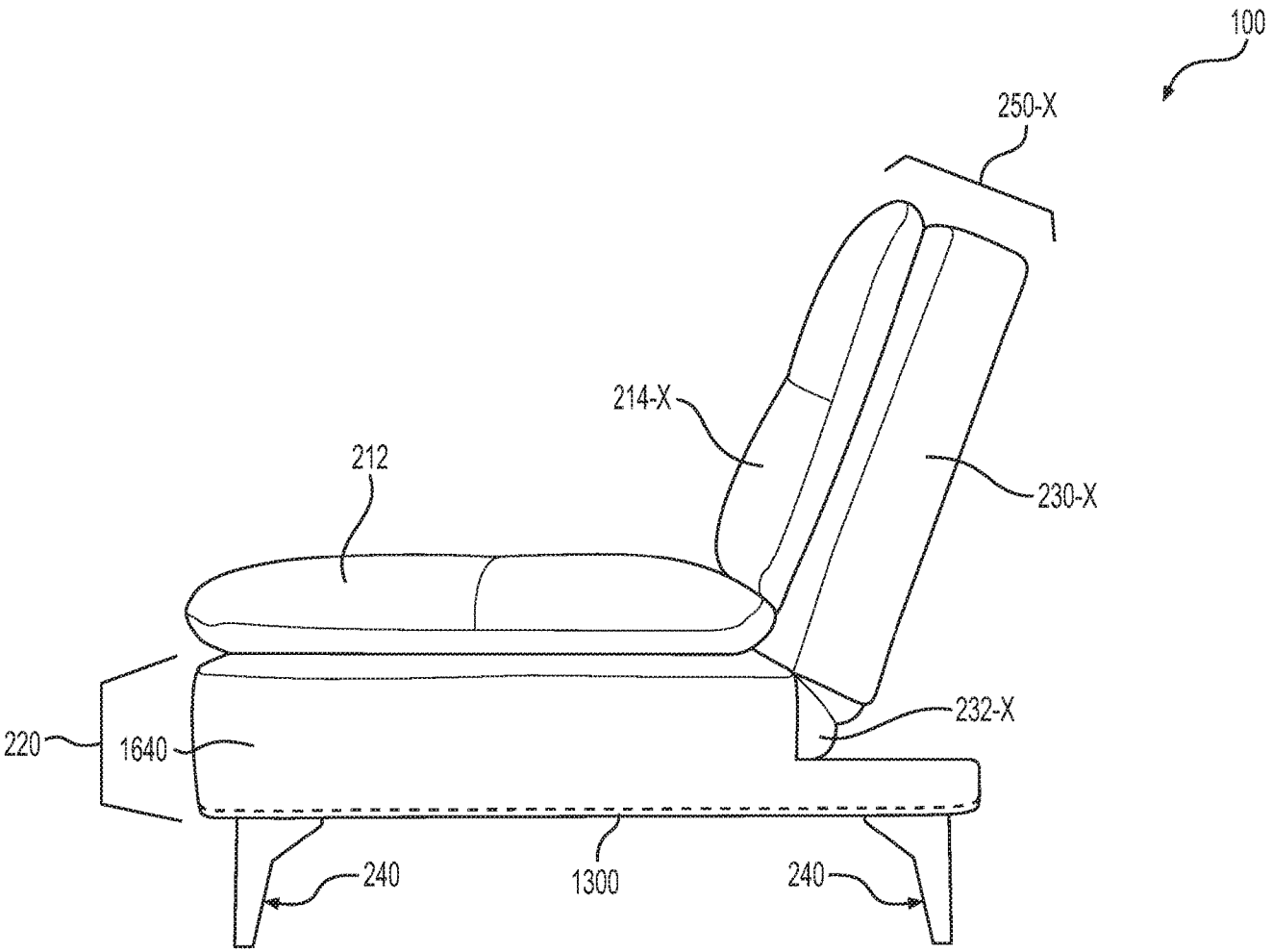
Figure 5:
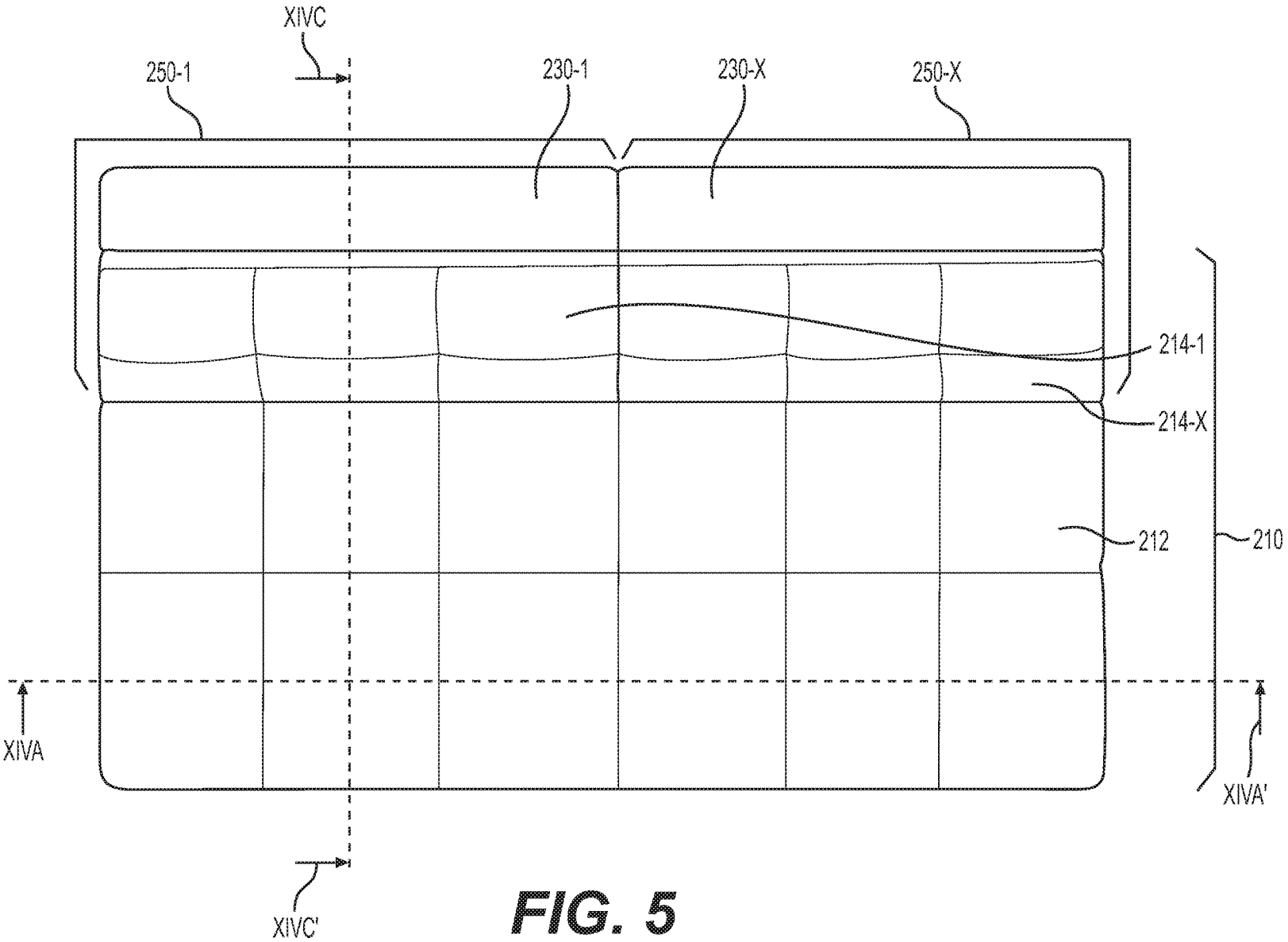
FIG. 5 is a top view of the first furniture object shown in FIG. 1, according to some example embodiments.
Figure 6:
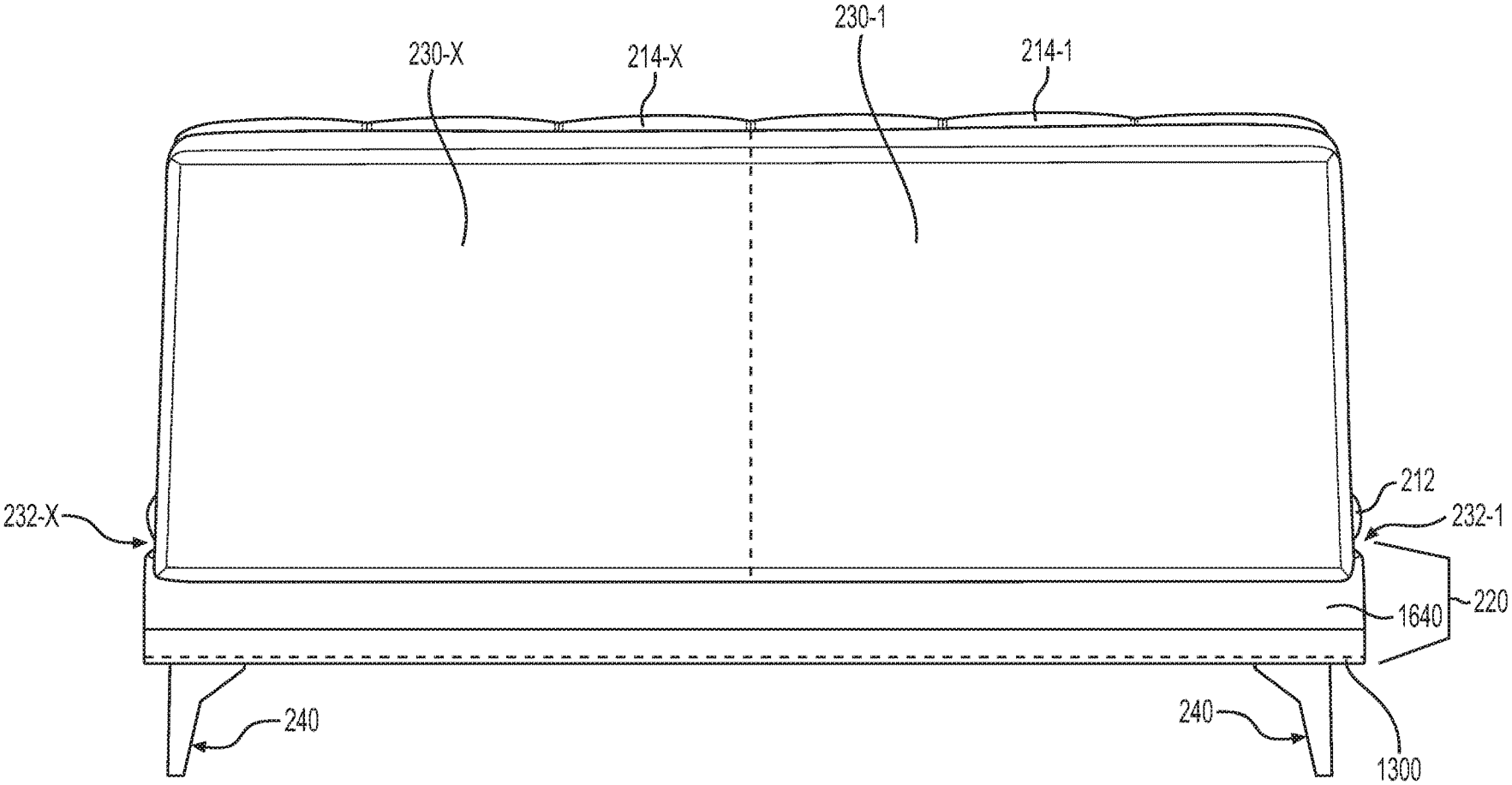
FIG. 6 is a top view of the first furniture object shown in FIG. 1, according to some example embodiments.

FIGS. 2A, 2B, 2C, and 2D are perspective views of the first furniture object shown in FIG. 1, according to some example embodiments. FIG. 3 is a front view of the first furniture object shown in FIG. 1, according to some example embodiments. FIGS. 4A and 4B are left-side and right-side views, respectively, of the first furniture object shown in FIG. 1, according to some example embodiments. FIG. 5 is a top view of the first furniture object shown in FIG. 1, according to some example embodiments. FIG. 6 is a rear view of the first furniture object shown in FIG. 1, according to some example embodiments.

In some example embodiments, a first furniture object 100 of the furniture set may be a furniture object configured to support a weight ("structural load") of a user. Such a furniture object may include a sofa, a bench, a chair, a bed, a sub-combination thereof, or a combination thereof. A sofa may be, for example, a convertible sofa. A chair may be, for example, a recliner.

Referring now to FIGS. 2A-6, the first furniture object 100 may be a convertible sofa that is configured to be at least partially converted between a sofa configuration (e.g., supporting a user in a seated position) and a bed configuration (e.g., supporting a user in a reclined and/or resting position), but it will be understood that example embodiments are not limited thereto. For example, the first furniture object 100 may be any furniture object that is configured to support a structural load, including a structural load of a human (e.g., a "user").

As shown in FIGS. 2A-6, and as further shown in FIGS. 13A-14C (described further below) the first furniture object 100 may include a seating assembly 210, a load-bearing support assembly 220, and a seal assembly 1300. As further shown, the first furniture object 100 may include one or more backrest assemblies 250-1 to 250-X (X being any positive integer) that may be collectively or independently adjusted between different recline angles to adjustably convert one or more portions of the convertible sofa that is the first furniture object 100 between one or more sofa configurations and one or more bed configurations. For example, in FIGS. 2A, 2B, and 2C the backrest assemblies 250-1 to 250-X are collectively adjusted between a first recline angle corresponding to a sofa configuration (FIG. 2A), a second recline angle corresponding to a deep recline configuration (FIG. 2B), and a third recline angle corresponding to a bed configuration (FIG. 2C). In a further example shown in FIG. 2D, backrest assembly 250-1 may be independently adjusted to one angle, for example the third recline angle shown in FIG. 2C, while backrest assembly 250-X may be independently adjusted to a separate recline angle, for example the first recline angle shown in FIG. 2A.

As shown in at least FIGS. 2A-6, the first furniture object 100 may include one or more leg structures 240. The one or more leg structures 240 may be detachably or fixedly (e.g., irreversibly) coupled to the load-bearing support assembly 220. In some example embodiments, the one or more leg structure 240 may be considered to be separate from the first furniture object 100. In some example embodiments, the one or more leg structures 240 may be considered to be a part of the load-bearing support assembly 220.

The seating assembly 210 may be on (e.g., on a top end of) the load-bearing support assembly 220. The seating assembly may be configured to receive a structural load (e.g., a weight of a user) and conduct the structural load to the load-bearing support assembly 220 while further providing cushioning of the structural load (e.g., via a spring assembly and/or cushion of the seating assembly 210).

Figure 14A:
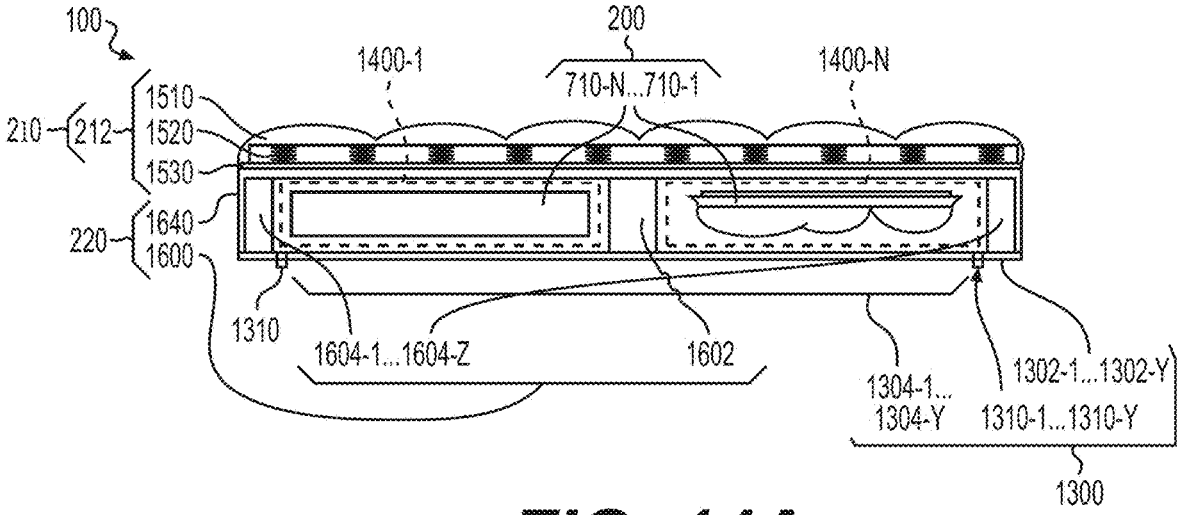
FIG. 14A is a cross-sectional view, along view line XIVA-XIVA' in FIGS. 2A and 3, of the first furniture object holding the disassembled second furniture object shown in FIG. 1 in sealable compartments of the first furniture object, according to some example embodiments.
Figure 14B:
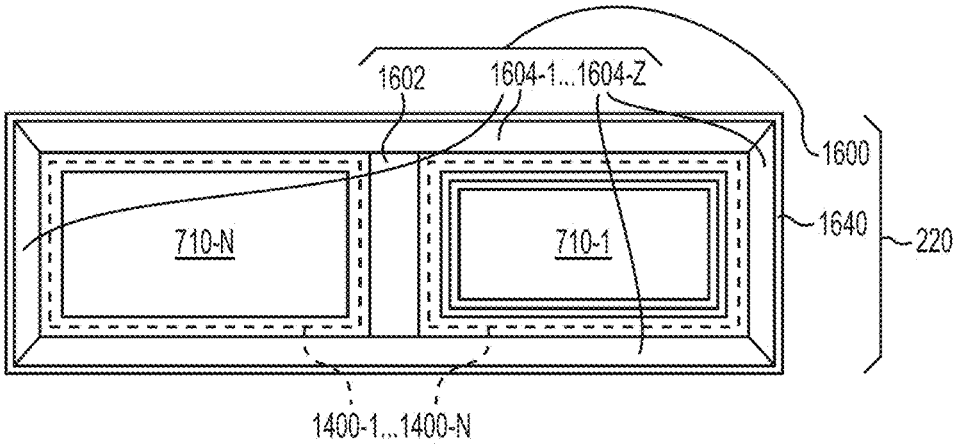
FIG. 14B is a cross-sectional view, along view line XIVB-XIVB' in FIGS. 2A and 5, of the first furniture object holding the disassembled second furniture object shown in FIG. 1 in sealable compartments of the first furniture object, according to some example embodiments.
Figure 14C:
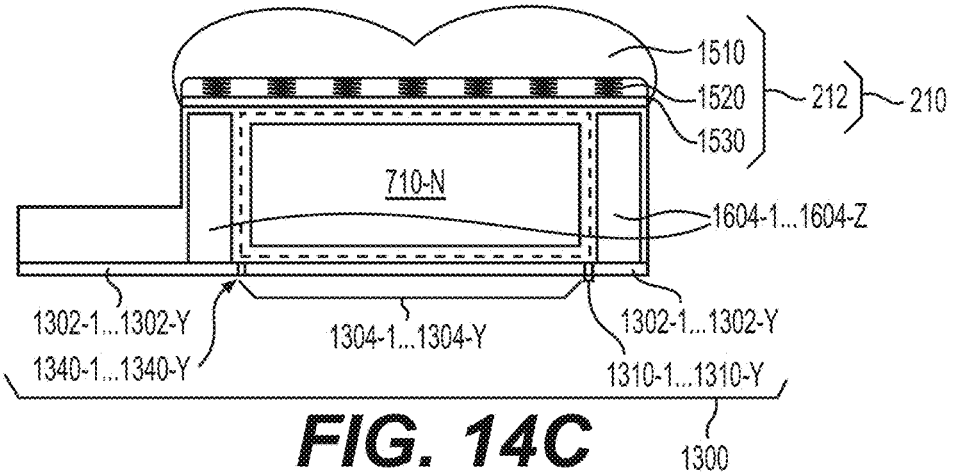
FIG. 14C is a cross-sectional view, along view line XIVC-XIVC' in FIGS. 2A and 5, of the first furniture object holding the disassembled second furniture object shown in FIG. 1 in sealable compartments of the first furniture object, according to some example embodiments.

As shown in FIGS. 14A-14C, the seating assembly 210 may include a cushion structure 1510 (e.g., padding material), a spring assembly 1520 (e.g., a plurality of springs), a bottom structure 1530, a sub-combination thereof, or a combination thereof. The spring assembly 1520 and/or the cushion structure 1510 may be configured to cushion the structural load. The bottom structure 1530 may be configured to conduct the structural load to the load-bearing support assembly 220.

Referring back to FIGS. 2A-6, the seating assembly 210 may include a seating portion 212 that is configured to be on a flat upper surface of the load-bearing support assembly 220 to form a seating surface of the first furniture object 100 and one or more backrest portions 214-1 to 214-X (X being the same value as referred to above with reference to the backrest assemblies 250-1 to 250-X), where each separate backrest portion 214-1 to 214-X is included in a separate backrest assembly 250-1 to 250-X, and each separate backrest portion 214-1 to 214-X is on a separate backrest support assembly 230-1 to 230-X (described further below with reference to the load-bearing support assembly 220).

Still referring to FIGS. 2A-6 and as further shown in FIGS. 13A-14C, load-bearing support assembly 220 may include a plurality of load-bearing beams 1600 and may be configured to support the structural load (e.g., conduct the structural load from the seating assembly 210 to a foundation element (e.g., a floor) without deformation or substantially without deformation (e.g., without deformation within manufacturing tolerances and/or material tolerances)). As shown in FIGS. 14A-14C, the plurality of load-bearing beams 1600 may include outer load-bearing beams 1604-1 to 1604-Z (Z being any positive integer) defining an outer side boundary of the load-bearing support assembly 220 and thus at least partially defining a volume and an interior of the load-bearing support assembly 220. As further shown in FIGS. 14A-14C, the plurality of load-bearing beams 1600 may further include one or more inner load-bearing beams 1602 extending through the volume defined by the outer load-bearing beams 1604-1 to 1604-N.

As further shown in at least FIGS. 2A-6 and 14A-14C, the load-bearing support assembly 220 may include an outer covering material 1640 that may cover at least a portion of the outer boundary of the load-bearing support assembly 220. The outer covering material 1640 may provide a cosmetic covering of the load-bearing support assembly 220, may provide structural protection of the plurality of load-bearing beams 1600, may at least partially define the volume of the load-bearing support assembly 220, a sub-combination thereof, or a combination thereof.

Referring now to FIGS. 2A-6, the first furniture object 100 may include one or more backrest assemblies 250-1 to 250-X and thus may include one or more backrest support assemblies 230-1 to 230-X, where each separate backrest support assembly 230-1 to 230-X is included in a separate backrest assembly 250-1 to 250-X, and each separate backrest support assembly 230-1 to 230-X is coupled to the load-bearing support assembly 220 via a separate, respective hinge assembly of the hinge assemblies 232-1 to 232-X. As shown in FIGS. 2A-6, therefore, each separate backrest assembly 250-1 to 250-X may include a separate backrest support assembly 230-1 to 230-X and a separate backrest portion 214-1 to 214-X of the seating assembly 210 that is on the separate backrest support assembly 230-1 to 230-X, and each separate backrest assembly 250-1 to 250-X may be coupled to the load-bearing support assembly 220 via a separate hinge assembly of the one or more hinge assemblies 232-1 to 232-X corresponding to the separate backrest assemblies 250-1 to 250-X.

Referring now to FIGS. 2A-6 and 13A-14C, the seal assembly 1300 may be on (e.g., on a bottom end of) the load-bearing support assembly 220. As shown, the seal assembly including one or more partition structures 1304-1 to 1304-Y, one or more remainder structures 1302-1 to 1302-Y, and one or more fastener assemblies 1310-1 to 1310-Y, with Y being any positive integer. The value of Y may be different with regard to different structures. For example, as shown in FIGS. 2A-6 and 13A-14C, Y=1 for the partition structures 1304-1 to 1304-Y, the remainder structures 1302-1 to 1302-Y, the hinge points 1340-1 to 1340-Y, the apertures 1320-1 to 1320-Y, and the fastener assemblies 1310-1 to 1310-Y, but in FIGS. 16A-16F Y=2 for the partition structures 1304-1 to 1304-Y while Y=1 for the remainder structures 1302-1 to 1302-Y.

As shown in FIGS. 13A-14C, the one or more partition structures 1304-1 to 1304-Y may define one or more sealable apertures 1320-1 to 1320-Y into an interior of the first furniture object 100, and the one or more partition structures 1304-1 to 1304-Y may be at least partially detached from the one or more remainder structures 1302-1 to 1302-Y to open ("expose") the one or more apertures 1320-1 to 1320-Y to expose the one or apertures 1320-1 to 1320-Y to the exterior of the first furniture object 100. Restated, the one or more partition structures 1304-1 to 1304-Y may be configured to at least partially open ("expose") the one or more apertures 1320-1 to 1320-Y to expose the one or apertures 1320-1 to 1320-Y to the exterior of the first furniture object 100 based on at least partially detaching from the one or more remainder structures 1302-1 to 1302-Y. In some example embodiments, the one or more partition structures 1304-1 to 1304-Y may be configured to completely ("entirely") detached from the one or more remainders structures 1302-1 to 1302-Y to expose the one or more apertures 1320-1 to 1320-Y.

Still referring to FIGS. 13A-14C, the one or more partition structures 1304-1 to 1304-Y may be at least partially attached to the one or more remainder structures 1302-1 to 1302-Y via the one or more fastener assemblies 1310-1 to 1310-Y, and the one or more partition structures 1304-1 to 1304-Y may be at least partially detached from the one or more remainder structures 1302-1 to 1302-Y based on disengaging at least a portion of the one or more fastener assemblies 1310-1 to 1310-Y from the one or more remainder structures 1302-1 to 1302-Y.

As shown in FIGS. 2A-6 and 13A-14C, the one or more partition structures 1304-1 to 1304-Y and the one or more remainder structures 1302-1 to 1302-Y may be a continuous (e.g., "unitary") piece of material (e.g., fabric) connected at hinge points 1340, where the hinge points 1340 may be one or more continuous (unitary) pieces of material extending between the one or more remainder structures 1302 and the one or more partition structures 1304-1 to 1304-Y, such that the partition structures 1304-1 to 1304-Y may be only partially detached from the remainder structure 1302-1 to 1302-Y via decoupling of the one or more fastener assemblies 1310-1 to 1310-Y, such that the one or more partition structures 1304-1 to 1304-Y remain attached to the one or more remainder structures 1302-1 to 1302-Y when the one or more partition structures 1304-1 to 13404-Y are at least partially detached from the one or more remainder structures 1302-1 to 1302-Y to open ("expose") one or more apertures 1320-1 to 1320-Y between the interior of the first furniture object 100 (e.g., the enclosures 1400-1 to 1400-N as described further below) and the exterior of the first furniture object 100. In some example embodiments, the one or more partition structures 1304-1 to 1304-Y may include a different material than the one or more remainder structures 1302-1 to 1302-Y.

As shown in FIGS. 2A-6 and 13A-14C, the seal assembly 1300 may include material that is coupled to the outer covering material 1640 of the load-bearing support assembly 220. In some example embodiments, the material at least partially comprising the seal assembly 1300 (e.g., the material comprising the one or more partition structures 1304-1 to 1304-Y and the one or more remainder structures 1302-1 to 1302-Y) and the material at least partially comprising the outer covering material 1640 may be a single, continuous (e.g., unitary) piece of material that extends over at least the side boundaries of the load-bearing support assembly 220 and a bottom and/or top end of the load-bearing support assembly 220 to define the seal assembly 1300.

The one or more fastener assemblies 1310-1 to 1310-Y may couple at least a portion of the one or more partition structures 1304-1 to 1304-Y and the one or more remainder structures 1302-1 to 1302-Y together. In some example embodiments, the one or more partition structures 1304-1 to 1304-Y are configured to reversibly detached from the one or more remainder structures 1302-1 to 1302-Y, such that, for example with regard to the example embodiments of FIGS. 13A-13C where the seal assembly 1300 includes a sole partition structure 1304-1, a sole remainder structure 1302-1 and a sole fastener assembly 1310-1, the sole partition structure 1304-1 may be partially detached from the sole remainder structure 1302-1 to reversibly open ("expose") the sole aperture 1320-1.

The one or more fastener assemblies 1310-1 to 1310-Y may be any type of fastener, including a zipper fastener, that is configured to attach at least a portion of at least one partition structure 1304-1 to 1304-Y to at least one remainder structure 1302-1 to 1302-Y. The one or more fastener assemblies 1310-1 to 1310-Y may, in some example embodiments, be configured to attach a partition structure 1304-1 to 1304-Y to a remainder structure 1302-1 to 1302-Y only once, such that the partition structure 1304-1 to 1304-Y cannot be reattached to the remainder structure 1302-1 to 1302-Y once detached therefrom. For example, the one or more fastener assemblies 1301-1 to 1310-Y may include a breakable seal, adhesive (e.g., tape and/or glue), some combination thereof, or the like. The one or more fastener assembly 1310-1 to 1310-Y may, in some example embodiments, be configured to reversibly detach a partition structure 1304-1 to 1304-Y from a remainder structure 1302-1 to 1302-Y, such that the partition structure 1304-1 to 1304-Y can be reattached to the remainder structure 1302-1 to 1302-Y once detached therefrom. In some example embodiments, different fastener assemblies 1310-1 to 1310-Y may be included in the first furniture object 100 and may couple separate partition structures 1304-1 to 1304-Y to one or more remainder structures 1302-1 to 1302-Y (e.g., one partition structure 1304-1 may be coupled to a remainder structure 1302-1 via a zipper-type fastener assembly 1310-1 and another partition structure 1304-Y may be coupled the remainder structure 1302-1 via an adhesive-type fastener assembly 1310-Y. In some example embodiments, a given partition structure 1304-1 to 1304-Y may be configured to be coupled to one or more remainder structures 1302-1 to 1302-Y via multiple, different fastener assemblies 1310-1 to 1310-Y, for example a zipper-type fastener and an adhesive fastener, such that the partition structure 1304-1 to 1304-Y may be reversibly detached from the one or more remainder structures 1302-1 to 1302-Y while providing an indication, based on breaking of the adhesive fastener, of whether the partition structure 1304-1 to 1304-Y has been detached from the one or more remainder structures 1302-1 to 1302-Y at least once.

Still referring to FIGS. 13A-14C, the load-bearing beams 1600, the seating assembly 210, and the seal assembly 1300 may collectively define one or more sealable enclosures 1400-1 to 1400-N (N being any positive integer) within the interior of the first furniture object 100 (e.g., the interior of the load-bearing support assembly 220), such that the first furniture object 100 includes one or more enclosures 1400-1 to 1400-N and the one or more partition structures 1304-1 to 1304-Y are configured to detach from one or more remainder structures 1302-1 to 1302-Y of the seal assembly 1300 to open one or more apertures 1320-1 to 1320-Y. As shown in at least FIGS. 13A-14C, N=2 and Y=1, such that the load-bearing beams 1600, the seating assembly 210, and the seal assembly 1300 collectively define two separate enclosures 1400-1 to 1400-N and the seal assembly 1300 includes a single partition structure 1304-1 that is configured to open a single aperture 1320-1 to expose both enclosures 1400-1 to 1400-N to the exterior of the first furniture object 100. But, it will be understood that example embodiments are not limited to the example embodiments shown in at least FIGS. 13A-14C, as N and Y may have independent values (e.g., the value of N may be independent of the value of Y). As shown in at least FIGS. 13A-14C, in some example embodiments, the plurality of load-bearing beams 1600 may define side boundaries of the one or more enclosures 1400-1 to 1400-N, the seating assembly 210 may define a top boundary of the one or more enclosures 1400-1 to 1400-N, and the seal assembly 1300 may define a bottom boundary of the one or more enclosures 1400-1 to 1400-N.

As shown in FIGS. 13A-14C, in some example embodiments, the plurality of load-bearing beams 1600, the seating assembly 210, and the seal assembly 1300 collectively define a plurality of enclosures 1400-1 to 1400-N within the interior of the first furniture object 100, where the plurality of enclosures 1400-1 to 1400-N are isolated from each other by at least one load-bearing beam of the plurality of load-bearing beams 1600. For example, as shown in FIGS. 13A-14C, the inner load-bearing beam 1602 divides the interior that is otherwise defined by the outer load-bearing beams 1604-1 to 1604-Z into two separate enclosures 1400-1 to 1400-N (e.g., N=2 with regard to the enclosures), such that the separate enclosures 1400-1 to 1400-N are isolated from each other by at least the inner load-bearing beam 1602.

As described further below, the first furniture object 100 may be configured to hold a plurality of separate pieces 710-1 to 710-N within the enclosure 1400 (the value of N with regard to the separate pieces 710-1 to 710-N may be independent of the value of N with regard to the one or more enclosures 1400-1 to 1400-N). The one or more partition structures 1304-1 to 1304-Y may be configured to detached from the one or more remainder structures 1302-1 to 1302-Y to open the one or more apertures 1320-1 to 1320-Y to enable removal of the plurality of separate pieces 710-1 to 710-N from the one or more enclosures 1400-1 to 1400-N through the one or more opened apertures 1320-1 to 1320-Y.

Figure 7:
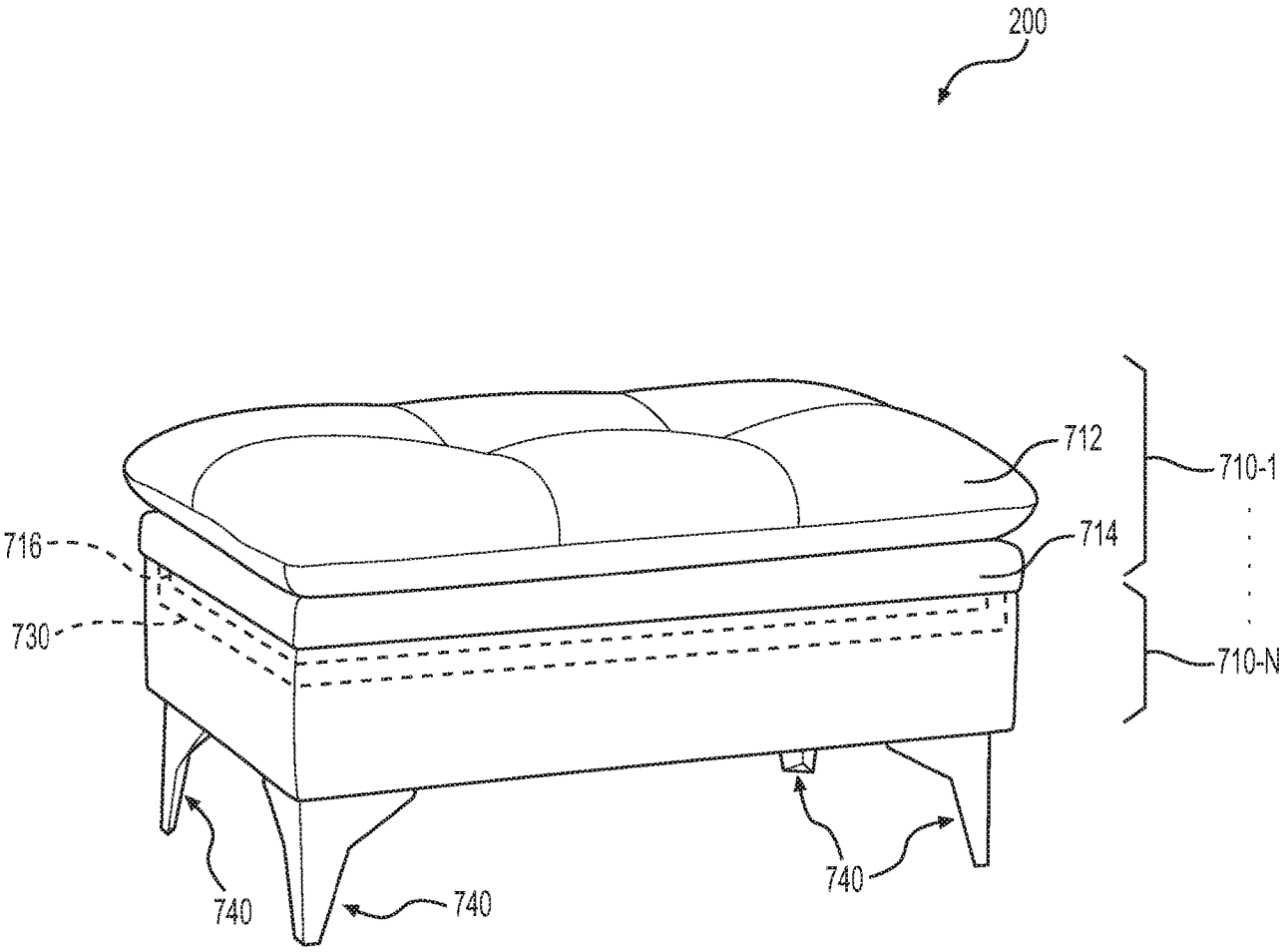
FIG. 7 is a perspective view of the assembled second furniture object shown in FIG. 1 in a first assembled configuration, according to some example embodiments.
Figure 8:
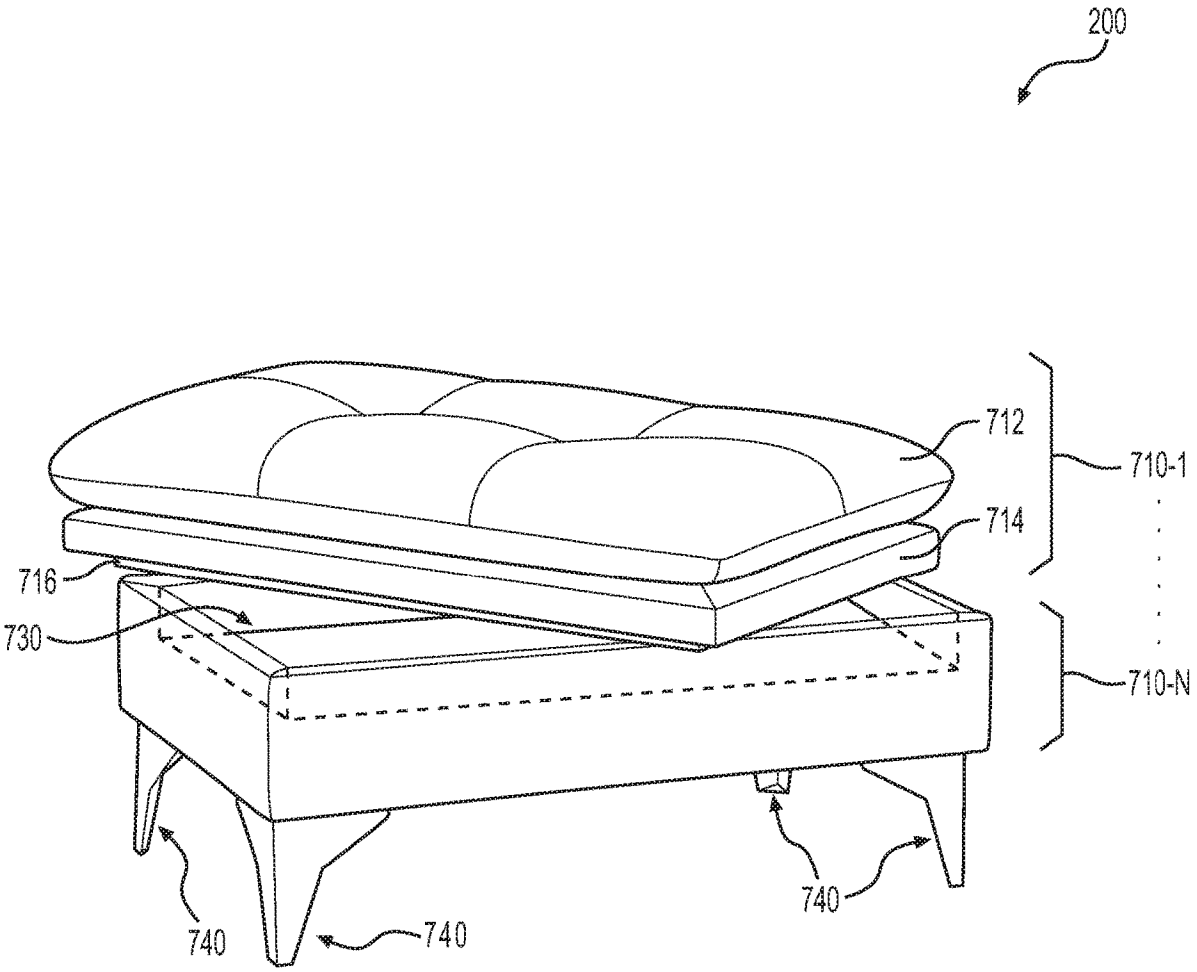
FIG. 8 is a perspective view of the assembled second furniture object shown in FIG. 1 in a disassembled configuration, according to some example embodiments.
Figure 9:
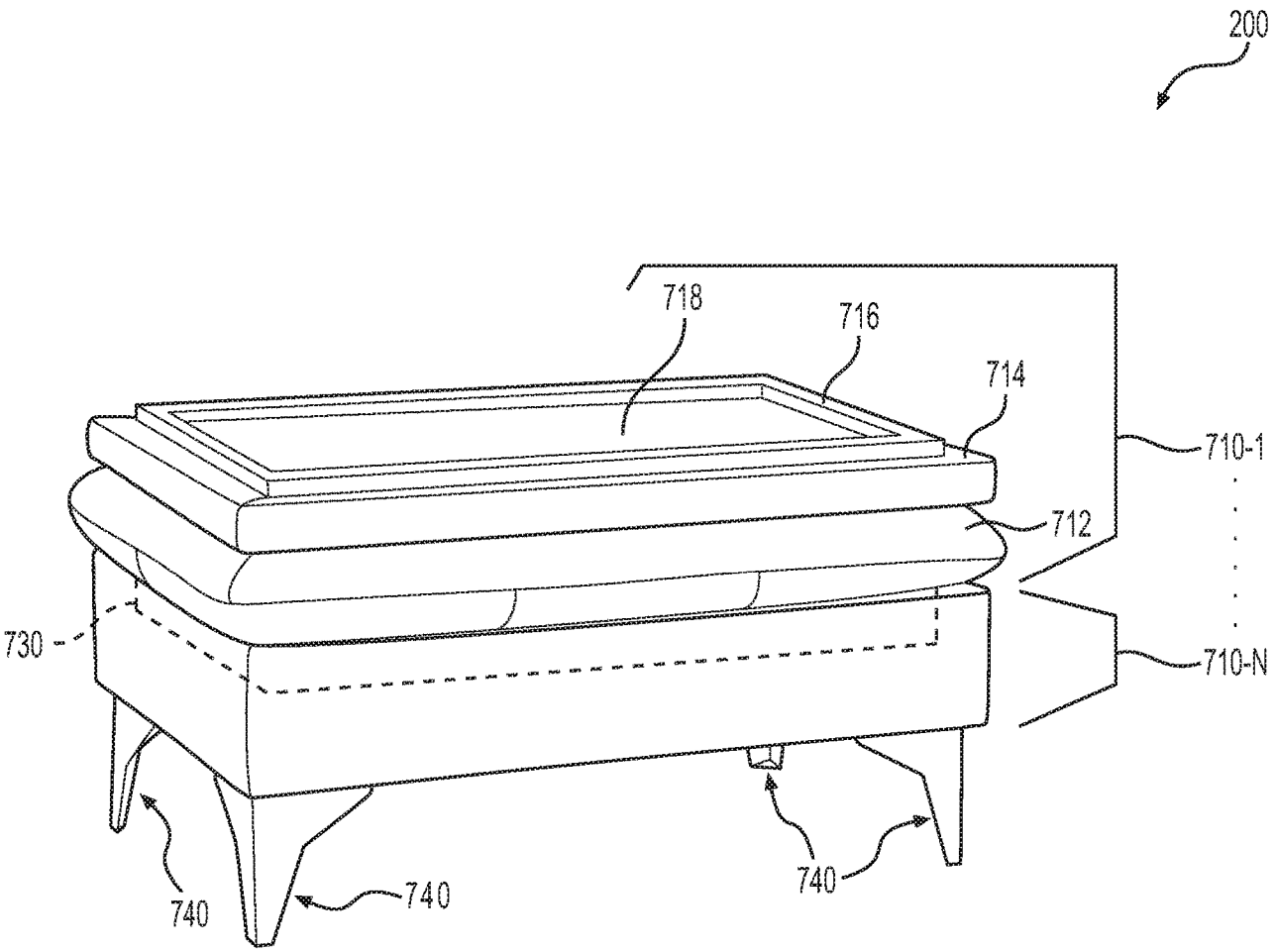
FIG. 9 is a perspective view of the assembled second furniture object shown in FIG. 1 in a second assembled configuration, according to some example embodiments.
Figure 10:
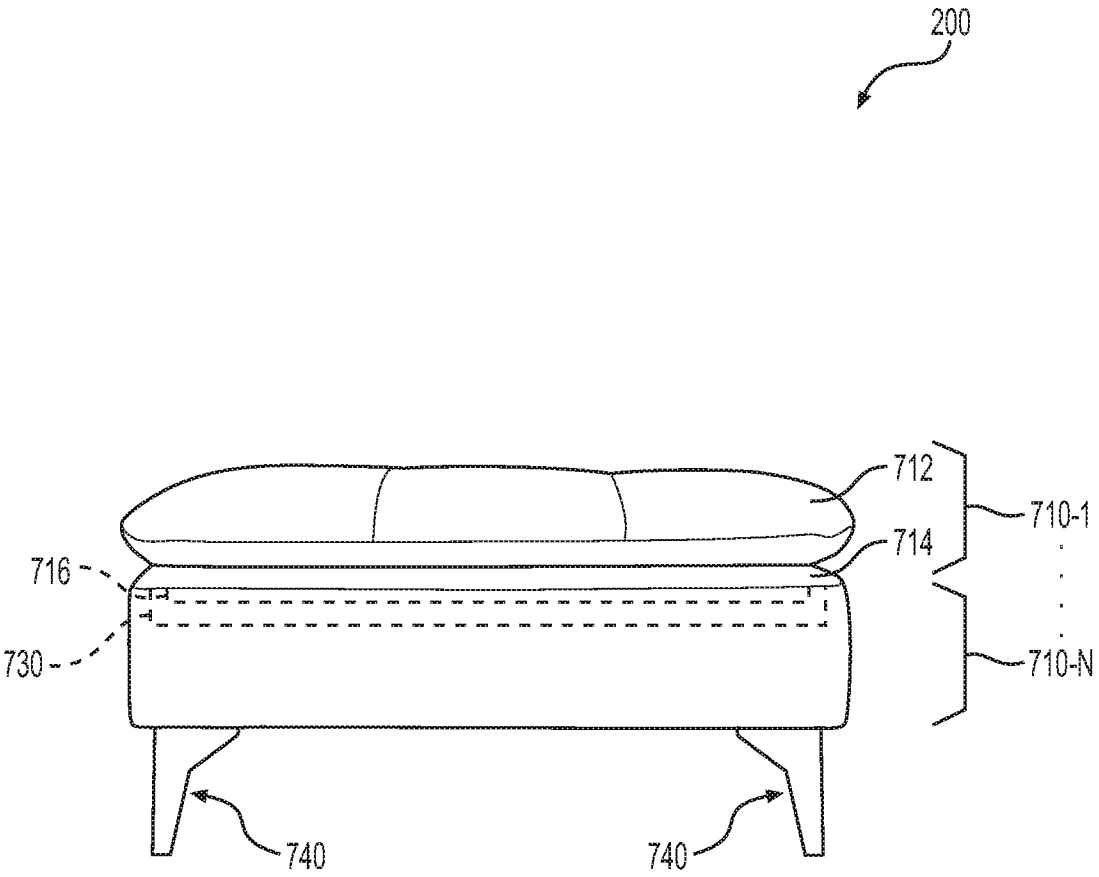
FIG. 10 is a front view of the second furniture object shown in FIG. 1, according to some example embodiments.
Figure 11:
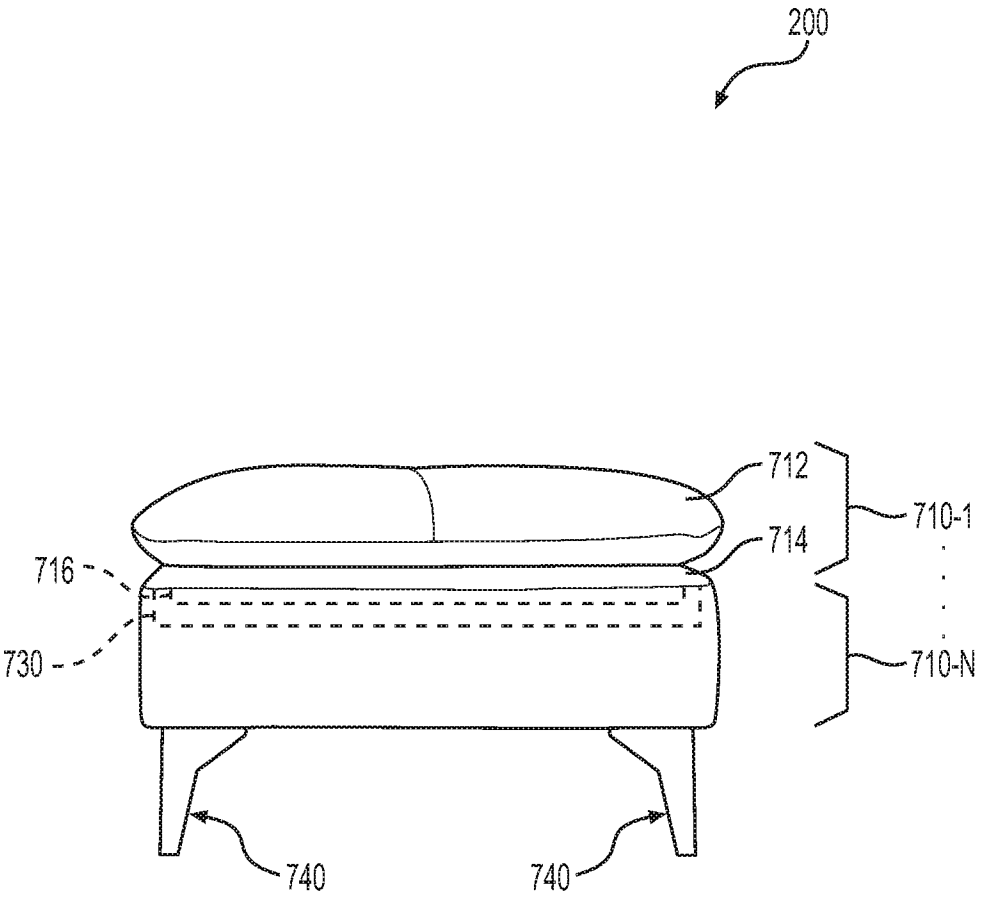
FIG. 11 is a side view of the second furniture object shown in FIG. 1, according to some example embodiments.
Figure 12:
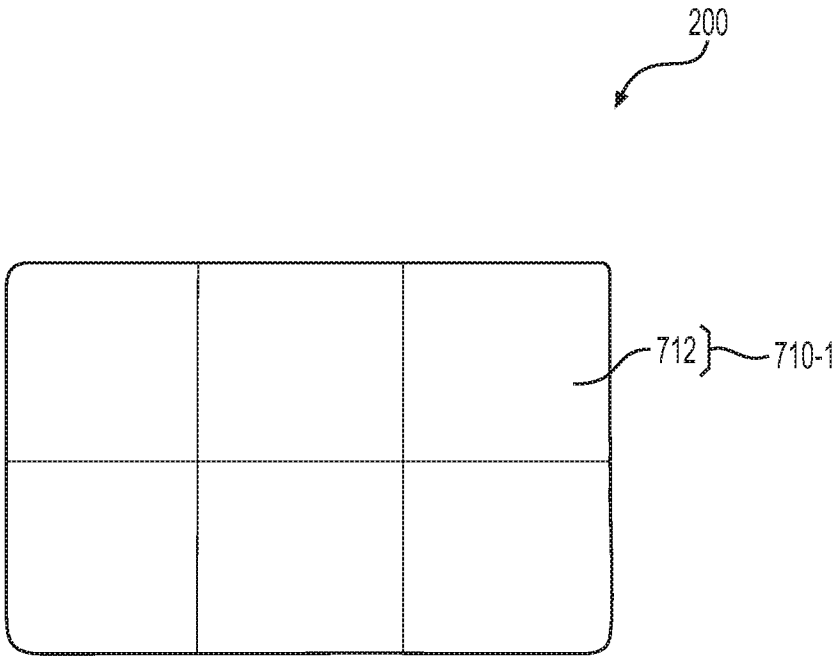
FIG. 12 is a top view of the second furniture object shown in FIG. 1, according to some example embodiments.

FIG. 7 is a perspective view of the assembled second furniture object shown in FIG. 1 in a first assembled configuration, according to some example embodiments. FIG. 8 is a perspective view of the assembled second furniture object shown in FIG. 1 in a disassembled configuration, according to some example embodiments. FIG. 9 is a perspective view of the assembled second furniture object shown in FIG. 1 in a second assembled configuration, according to some example embodiments. FIG. 10 is a front view of the assembled second furniture object shown in FIG. 1, according to some example embodiments. FIG. 11 is a side view of the assembled second furniture object shown in FIG. 1, according to some example embodiments. FIG. 12 is a top view of the assembled second furniture object shown in FIG. 1, according to some example embodiments.

As shown in FIGS. 7-12, a second furniture object 200 of the furniture set 10 may be an ottoman. As further shown, the second furniture object 200 may include one or more separate pieces 710-1 to 710-N (N being any positive integer). In some example embodiments, N=1 with regard to the one or more separate pieces 710-1 to 710-N, such that the second furniture object 200 is a single-piece 710-1 object.

In some example embodiments, including the example embodiments shown in FIGS. 7-12 and 13A-14C, where N with regard to the one or more separate pieces 710-1 to 710-N is greater than 1 (e.g., N=2 as shown in FIGS. 13A-14C), the separate pieces 710-1 to 710-N may be coupled together to assemble the second furniture object 200 in one or more assembled configurations of the second furniture object 200. The separate pieces 710-1 to 710-N may be configured to be coupled together in different configurations to assemble the second furniture object in different assembled configurations that correspond with the second furniture object 200 being different types of furniture.

For example, as shown in FIG. 8, the first piece 710-1 may be a top cushion piece that includes a cushion padding structure 712 on one side of the first piece 710-1 and a tray structure 714 with a protrusion structure 716 on the opposite side of the first piece 710-1, the cushion padding structure 712 being coupled to the tray structure 714. In addition, as further shown in FIGS. 7-12, a separate piece 710-N of the second furniture object 200 may include structural elements that define a partial enclosure 730 extending into an interior ("interior volume") of the separate piece 710-N, and the first piece 710-1 may be configured to detachably couple with the separate piece 710-N in a first configuration where the protruding structure 716 is inserted into the partial enclosure 730, as shown in at least FIG. 7, to establish a protrusion/receptacle interface connection to assemble the second furniture object 200 in a first assembled configuration such that the second furniture object 200 is an ottoman (e.g., the cushion padding structure 712 faces away from the separate object 710-N).

In another example, as shown in FIG. 9, the first piece 710-1 may be configured to detachably couple with the separate piece 710-N in a second assembled configuration that is different from the first assembled configuration, where at least a portion of the cushion padding structure 712 is inserted into the partial enclosure 730 so that the tray structure 714 is exposed and a surface 718 of the tray structure 714 that faces away from the separate piece 710-N (and may be bounded by the protrusion structure 716) defines a table surface, such that the second furniture object 200 in the second assembled configuration is a table.

As shown in FIGS. 7-12, the separate pieces 710-1 to 710-N may be detachably coupled together based on fitting complementary interface structures (e.g., protrusion structure 716 and partial enclosure 730) together, but example embodiments are not limited thereto. For example, partial enclosure 730 and protrusion structure 716 may be omitted from the separate pieces 710-1 to 710-N. In some example embodiments, the partial enclosure 730 may occupy a substantial portion (e.g., >10%) of the internal volume of at least the separate piece 710-N, such that the partial enclosure 730 may be configured to provide a storage area within the second furniture object 200 when the second furniture object 200 is assembled in one or more assembled configurations.

Still referring to FIGS. 7-12, the second furniture object 200 may include a set of one or more leg structures 740. Similarly to the leg structure 240 described above, the one or more leg structures 740 may be detachably or fixedly (e.g., irreversibly) coupled to the at least one of the pieces 710-1 to 710-N (for example piece 710-N as shown in FIGS. 7-12). In some example embodiments, the one or more leg structures 740 may be considered to be separate from the second furniture object 200. In some example embodiments, the one or more leg structures 740 may be considered to be a part of one or more of the pieces 710-1 to 710-N (e.g., a part of piece 710-N).

Figure 13A:
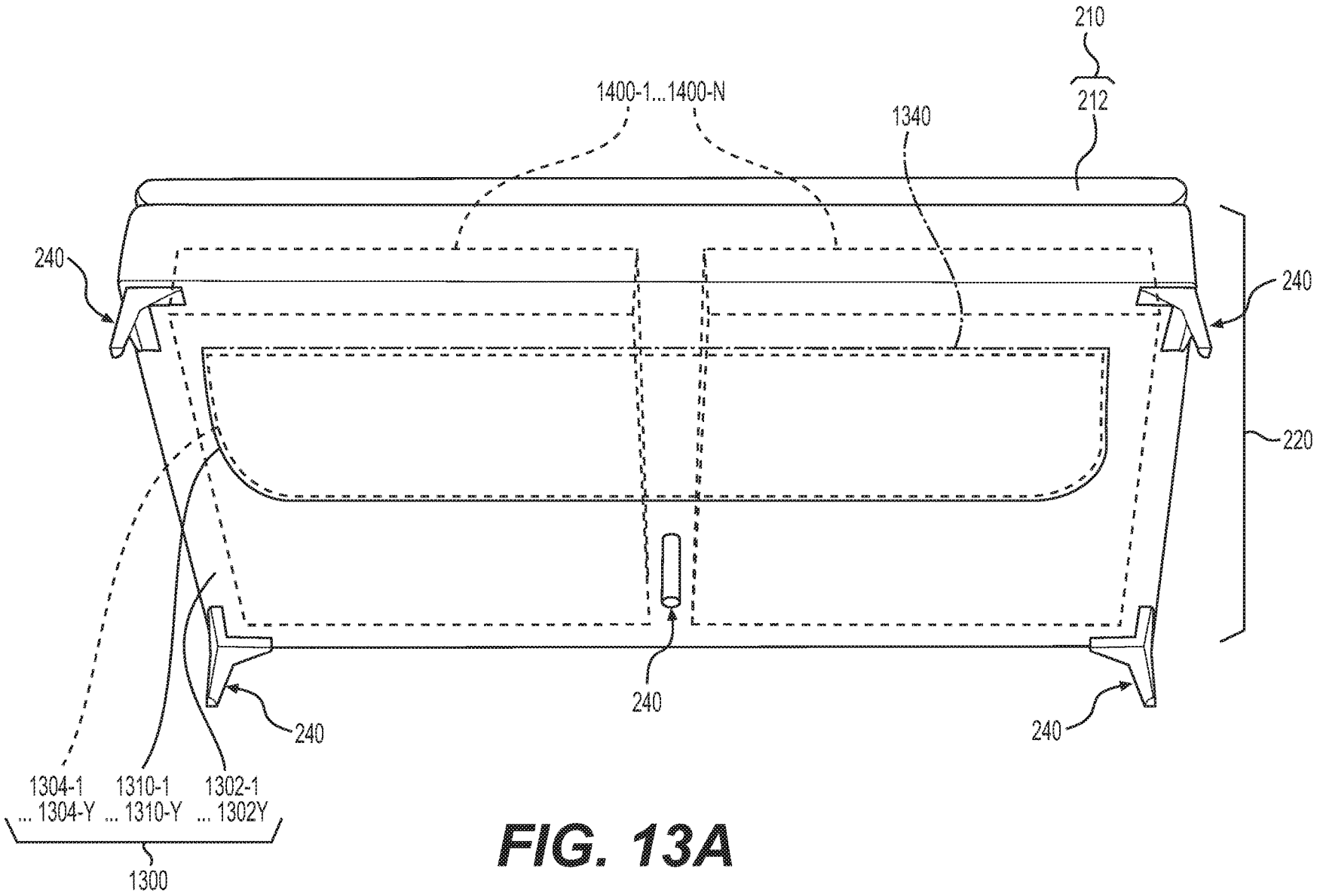
FIGS. 13A, 13B, and 13C are bottom-front views of the first furniture object holding the disassembled second furniture object shown in FIG. 1 in sealable compartments of the first furniture object, according to some example embodiments
Figure 13B:
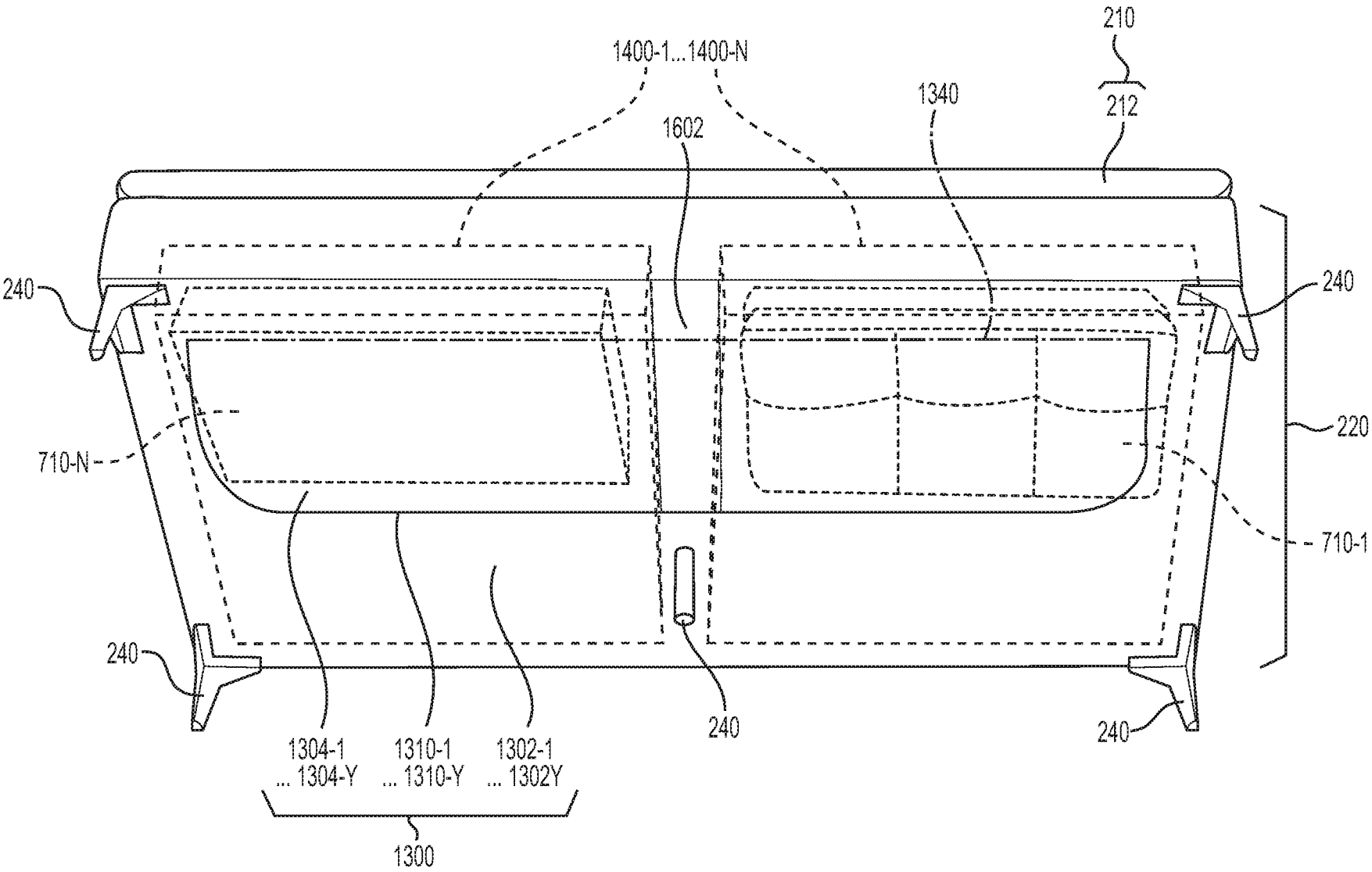
Figure 13C:
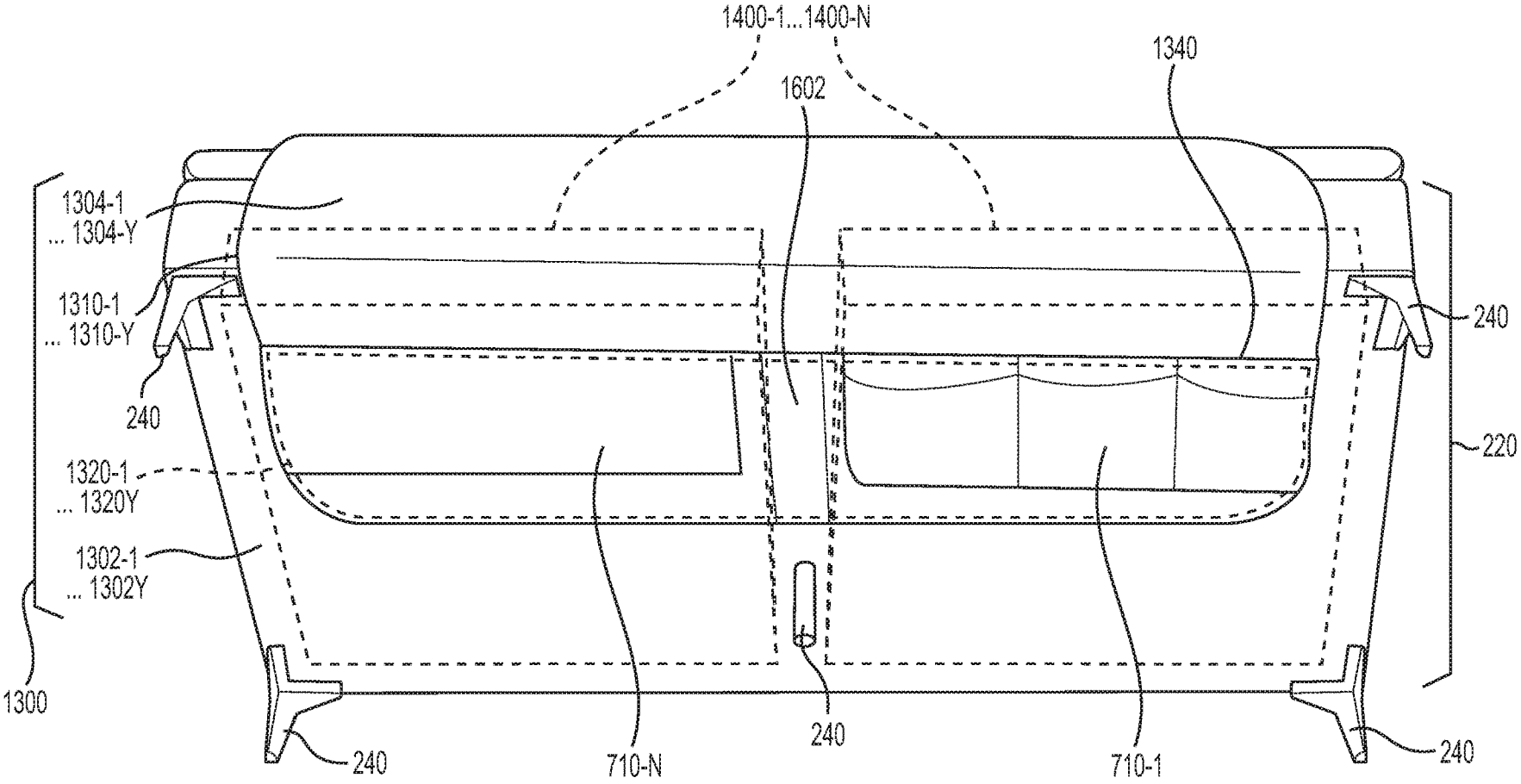

FIGS. 13A, 13B, and 13C are bottom-front views of the first furniture object holding the disassembled second furniture object shown in FIG. 1 in sealable compartments of the first furniture object, according to some example embodiments. FIG. 14A is a cross-sectional view, along view line XIVA-XIVA' in FIGS. 2A and 5 of the first furniture object holding the disassembled second furniture object shown in FIG. 1 in sealable compartments of the first furniture object, according to some example embodiments. FIG. 14B is a cross-sectional view, along view line XIVB-XIVB' in FIGS. 2A and 3, of the first furniture object holding the disassembled second furniture object shown in FIG. 1 in sealable compartments of the first furniture object, according to some example embodiments. FIG. 14C is a cross-sectional view, along view line XIVC-XIVC' in FIGS. 2A and 5, of the first furniture object holding the disassembled second furniture object shown in FIG. 1 in sealable compartments of the first furniture object, according to some example embodiments.

Referring to FIGS. 13A-14C, in some example embodiments, one or more separate pieces 710-1 to 710-N of the second furniture object 200 may be inserted into the one or more enclosures 1400-1 to 1400-N of the first furniture object 100, and the one or more partition structures 1304-1 to 1304-Y may be configured to seal the one or more apertures 1320-1 to 1302-Y while the one or more separate pieces 710-1 to 710-N are in the one or more enclosures 1400-1 to 1400-N. Accordingly, the first furniture object 100 may be configured to hold the one or more separate pieces 710-1 to 710-N within the one or more enclosures 1400-1 to 1400-N, and the one or more partition structures 1304-1 to 1304-Y are configured to detach from one or more remainder structures 1302-1 to 1302-Y of the seal assembly 1300 to open the one or more apertures 1320-1 to 1320-Y to enable removal of the one or more separate pieces 710-1 to 710-N from the one or more enclosures 1400-1 to 1400-N through the one or more opened apertures 1320-1 to 1320-Y. Where N>1 with regard to the separate pieces 710-1 to 710-N, the separate pieces 710-1 to 710-N, once removed from the one or more enclosures 1400-1 to 1400-N, may be coupled together in one or more configurations to assemble the second furniture object 200 externally to the first furniture object 100 to establish the furniture set 10.

Accordingly, the second furniture object 200 may be stored, in one piece or multiple separate pieces, in one or more sealable enclosures 1400-1 to 1400-N within the interior of the first furniture object 100. As a result, the volume occupied by the furniture set 10 (the collective first and second furniture objects 100, 200) during storage and/or transport of the furniture set 10 may be reduced, thereby improving efficiencies and reducing costs associated with said storage and/or transport, and further providing protection to the one or more pieces 710-1 to 710-N of the second furniture object 200 via one or more elements of the first furniture object 100, in addition to any packaging material that may be provided around the first furniture object 100 during storage and/or transport of same.

In some example embodiments, the one or more separate pieces 710-1 to 710-N of the second furniture object 200 may be, independently or subsequently to disassembly of the second furniture object 200 into the one or more separate pieces 710-1 to 710-N, inserted into the one or more enclosures 1400-1 to 1400-N via one or more open apertures 1320-1 to 1320-Y, and the one or more partition structures 1304-1 to 1304-Y may be attached to the one or more remainder structures 1302-1 to 1302-Y to seal the one or more apertures 1320-1 to 1320-Y, thereby securing the one or more separate pieces 710-1 to 710-N within the one or more enclosures 1400-1 to 1400-N.

In some example embodiments, a given enclosure of the one or more enclosures 1400-1 to 1400-N may have a size, shape, volume, a sub-combination thereof, or a combination thereof that matches or substantially matches (e.g., matches within manufacturing tolerances and/or material tolerances) a corresponding size, shape, volume, a sub-combination thereof, or a combination thereof of a particular separate piece of the one or more separate pieces 710-1 to 710-N, such that the particular piece occupies an entirety or substantially an entirety (e.g., an entirety within manufacturing tolerances and/or material tolerances) of the given enclosure. As an example, and with reference to FIGS. 13A-14C, in some example embodiments, the enclosures 1400-1 to 1400-N may each have a size that substantially matches a volume of a separate piece of the plurality of separate pieces 710-1 to 710-N, such that each separate piece occupies substantially an entirety of a separate enclosure of the plurality of enclosures 1400-1 to 1400-N. Thus, the separate pieces 710-1 to 710-N may be protected from damage that may occur due to jostling and/or shifting of the separate pieces 710-1 to 710-N within significantly larger enclosures 1400-1 to 1400-N and/or enclosures 1400-1 to 1400-N having different shapes than the pieces held within.

As further shown in FIGS. 13A-14C, in some example embodiments, the first furniture object 100 includes multiple enclosures 1400-1 to 1400-N that are isolated from each other (e.g., by inner load-bearing beam 1602 partitioning the enclosures 1400-1 to 1400-N from each other), such that separate pieces 710-1 to 710-N held in separate enclosures 1400-1 to 1400-N may be isolated from each other, thereby providing additional protection to the separate pieces 710-1 to 710-N from damage that may be incurred due to contact (e.g., impact) with each other as a result of being held in a common enclosure.

Figure 15:
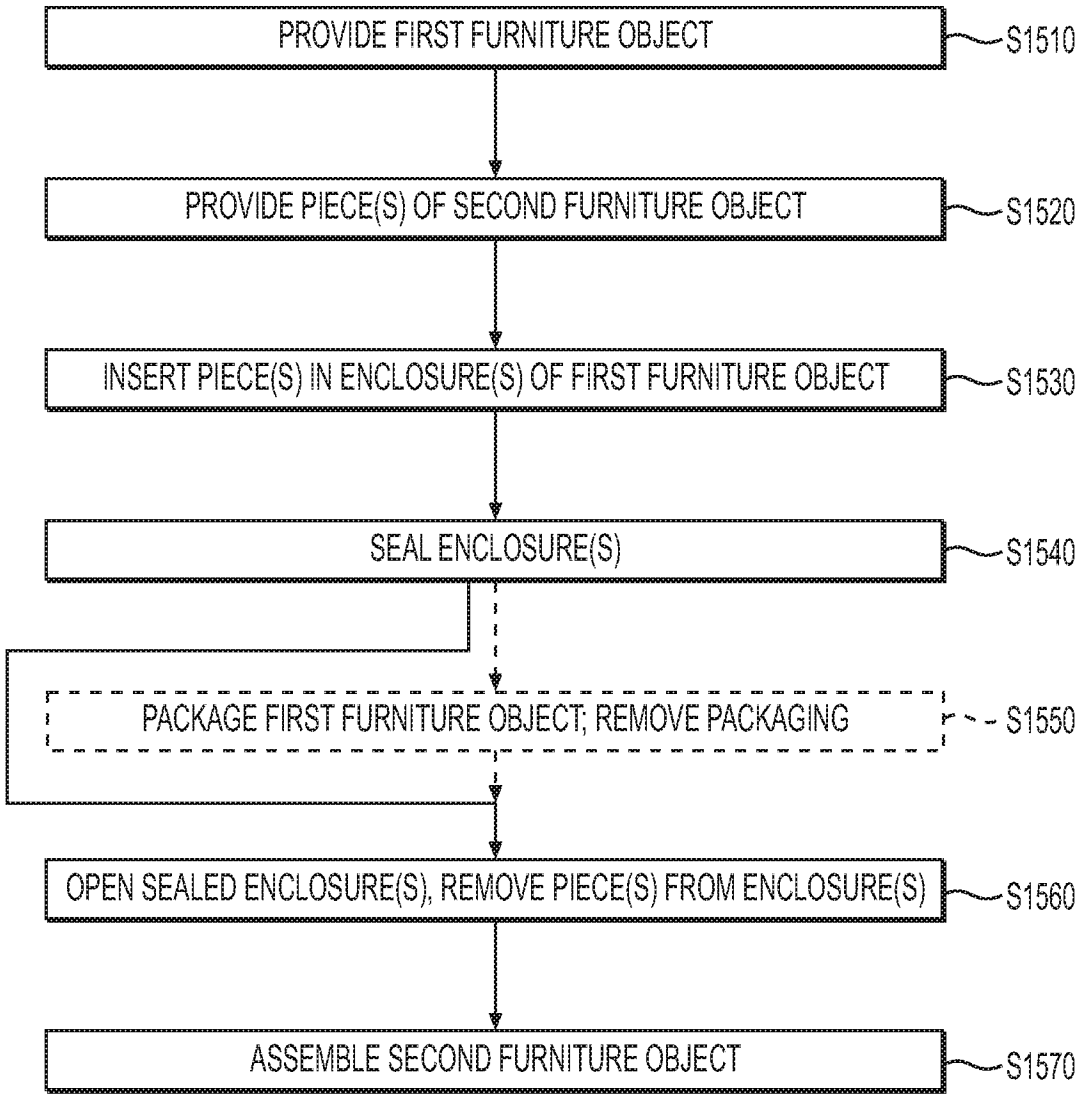
FIG. 15 is a flowchart illustrating a method, according to some example embodiments.

FIG. 15 is a flowchart illustrating a method, according to some example embodiments. FIGS. 16A, 16B, 16C, 16D, 16E, and 16F illustrate manipulation of various elements of a furniture set according to one or more operations of the method of FIG. 15, according to some example embodiments.

Figure 16A:
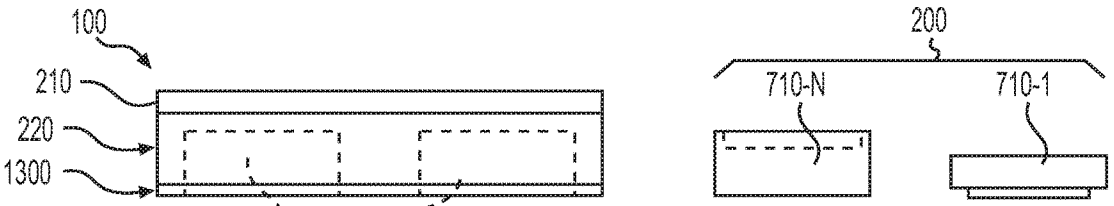
FIGS. 16A, 16B, 16C, 16D, 16E, and 16F illustrate manipulation of various elements of a furniture set according to one or more operations of the method of FIG. 15, according to some example embodiments.

Referring to FIGS. 15 and 16A, at S1510, a first furniture object 100 is provided and, at S1520, one or more separate pieces 710-1 to 710-N of a second furniture object 200 are provided. In FIGS. 16A-16F, N>1 and in fact N=2 with regard to the separate pieces 710-1 to 710-N, but example embodiments are not limited thereto (e.g., N may equal 1 or may be greater than 2). The providing of the first furniture object 100 at S1510 may include fabricating (e.g., manufacturing, assembling, or a combination thereof) the first furniture object 100, receiving the first furniture object, a sub-combination thereof, or a combination thereof. The providing of the one or more separate pieces 710-1 to 710-N of the second furniture object 200 at S1520 may include fabricating (e.g., manufacturing, assembling, or a combination thereof) the one or more separate pieces 710-1 to 710-N, receiving the one or more separate pieces 710-1 to 710-N, disassembling the second furniture object 200 into the one or more separate pieces 710-1 to 710-N, a sub-combination thereof, or a combination thereof.

Figure 16B:
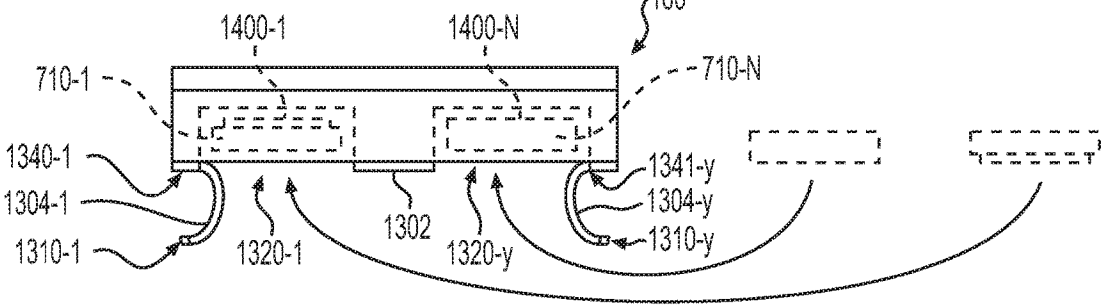

Referring to FIGS. 15 and 16B, at S1530, the one or more separate pieces 710-1 to 710-N are inserted into the one or more enclosures 1400-1 to 1400-N. Such insertion may include at least partially detaching one or more partition structures 1304-1 to 1304-Y from one or more remainder structures 1302-1 to 1302-Y of the seal assembly 1300 (e.g., based on decoupling one or more fastener assemblies 1310-1 to 1310-Y) to open one or more apertures 1320-1 to 1320-Y that expose the one or more enclosures 1400-1 to 1400-N to the exterior of the first furniture object 100, and the one or more separate pieces 710-1 to 710-N are inserted into the one or more enclosures 1400-1 to 1400-N (e.g., into separate, respective enclosures as shown in FIG. 16B) through the one or more opened apertures 1320-1 to 1320-Y. In FIGS. 16A-16F, N>1 and in fact N=2 with regard to the separate enclosures 1400-1 to 1400-N, but example embodiments are not limited thereto (e.g., N may equal 1 or may be greater than 2), and the value of N with regard to the one or more enclosures 1400-1 to 1400-N may be different from the value of N with regard to the one or more separate pieces 710-1 to 710-N. In FIGS. 16A-16F, Y>1 and in fact Y=2 with regard to the one or more partition structures 1304-1 to 1304-Y, the one or more apertures 1320-1 to 1320-Y, the one or more remainder structures 1302-1 to 1302-Y, and the one or more fastener assemblies 1310-1 to 1310-Y, but example embodiments are not limited thereto (e.g., N may equal 1 or may be greater than 2), and the respective values of Y with regard to said elements of the seal assembly 1300 may be different each other (e.g., Y may equal 1 with regard to the one or more remainder structures 1302-1 to 1302-Y and Y may simultaneously equal 2 with regard to the one or more partition structures 1304-1 to 1304-Y, the one or more apertures 1320-1 to 1320-Y, and the one or more fastener assemblies 1310-1 to 1310-Y.

As shown in FIG. 16B, the one or more partition structures 1304-1 to 1304-Y and the one or more remainder structures 1302-1 to 1302-Y may be a continuous (e.g., "unitary") piece of material (e.g., fabric) connected at hinge points 1340, such that the one or more partition structures 1304-1 to 1304-Y may be only partially detached from the one or more remainder structures 1302-1 to 1302-Y via decoupling of the one or more fastener assemblies 1310-1 to 1310-Y, such that the one or more partition structures 1304-1 to 1304-Y remain attached to the one or more remainder structures 1302-1 to 1302-Y during operation S1530.

Figure 16C:
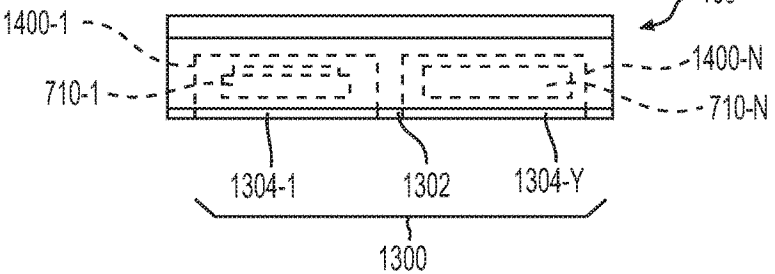

Referring to FIGS. 15 and 16C, at 51540 the one or more partition structures 1304-1 to 1304-Y may be attached to the one or more remainder structures 1302-1 to 1302-Y to close the one or more apertures 1320-1 to 1320-Y and to thus seal the one or more enclosures 1400-1 to 1400-N from the exterior of the first furniture object 100.

Figure 16D:
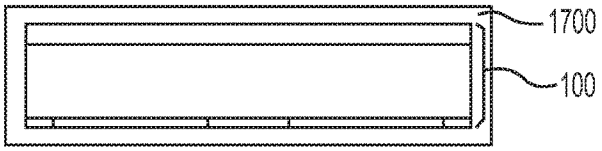

Referring to FIGS. 15 and 16D, in some example embodiments, and at S1550, the first furniture object 100 that is holding the one or more separate pieces 710-1 to 710-N within the one or more enclosures 1400-1 to 1400-N may be inserted into, encased in, wrapped in, etc. one or more instances of packaging 1700 to protect the first furniture object 100 (and the one or more separate pieces 710-1 to 710-N held within) from damage. The packaged first furniture object 100 with one or more separate pieces 710-1 to 710-N held within may then be stored, transported, or a combination thereof.

Subsequently to S1550, the packaging 1700 may be removed, for example upon the completion of transport of the first furniture object 100 to an end-user location (e.g., a user's home).

Figure 16E:
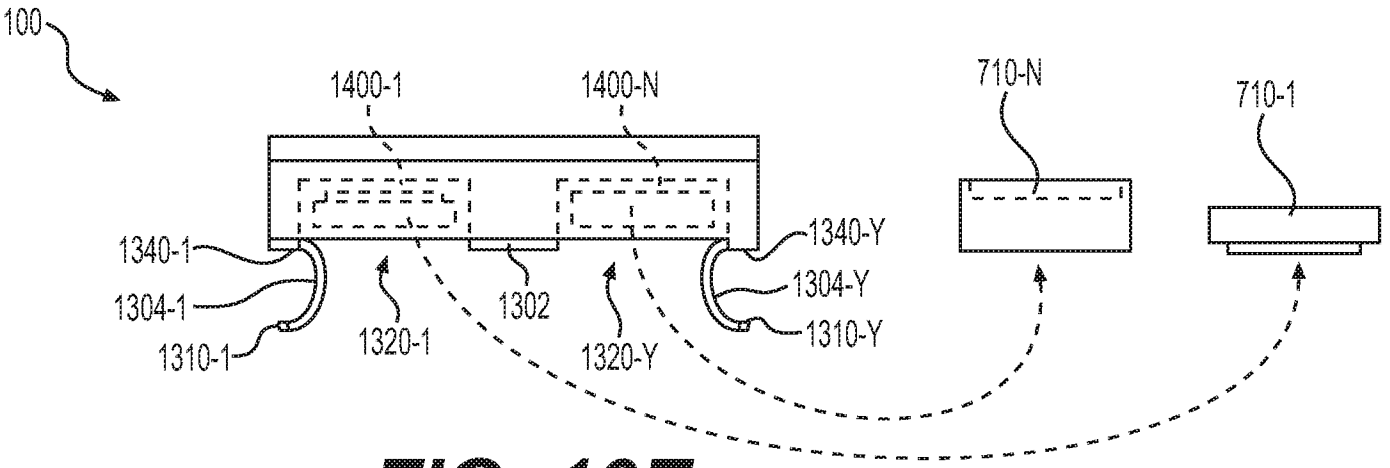

Referring to FIGS. 15 and 16E, at S1560, the one or more partition structures 1304-1 to 1304-Y may be partially or entirely detached from the one or more remainder structures 1302-1 to 1302-Y of the seal assembly 1300 (e.g., based on manipulation and/or at least partial decoupling of the one or more fastener assemblies 1310-1 to 1310-Y) to open the one or more apertures 1320-1 to 1320-Y to expose the one or more enclosures 1400-1 to 1400-N, and the one or more separate pieces 710-1 to 710-N held within, to the exterior of the first furniture object 100. The one or more separate pieces 710-1 to 710-N may then be removed from the one or more enclosures 1400-1 to 1400-N via the opened one or more apertures 1320-1 to 1320-Y. In some example embodiments, the one or more partition structures 1304-1 to 1304-Y may be entirely and/or permanently (e.g., irreversibly) detached from the one or more remainder structures 1302-1 to 1302-Y, such that the one or more enclosures 1402-1 to 1400-N remain exposed to the exterior of the first furniture object 100. In some example embodiments, the one or more partition structures 1304-1 to 1304-Y may be reversibly detached from the one or more remainder structures 1302-1 to 1302-Y at S1560 (e.g., the one or more fastener assemblies 1310-1 to 1310-Y may be one or more zippers that are configured to be reversibly manipulated to reversibly detach (e.g., detach and later reattach without any change in structural integratory of the seal assembly 1300) the one or more partition structures 1304-1 to 1304-Y and the one or more remainder structures 1302-1 to 1302-Y together.

Figure 16F:
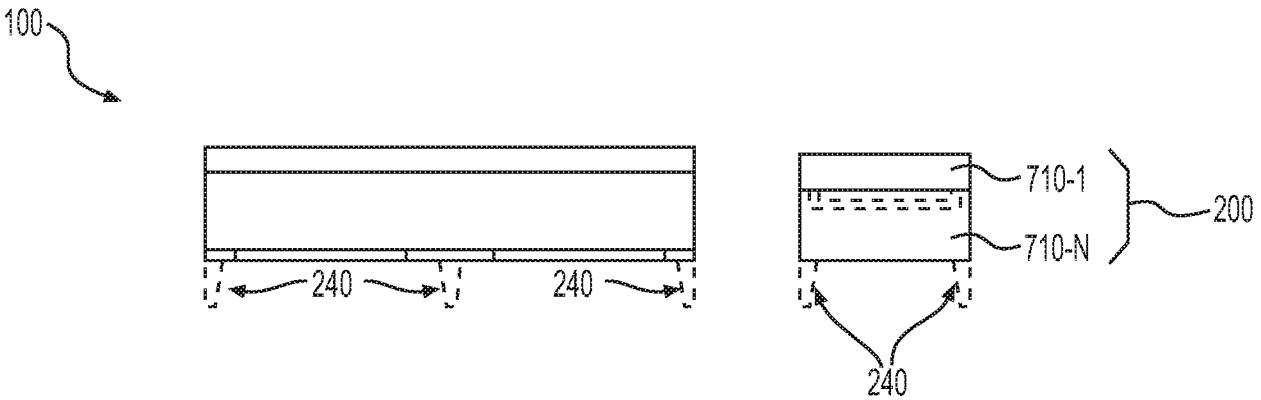

Referring to FIGS. 15 and 16F, at S1570, where N>1 with regard to the one or more separate pieces 710-1 to 710-N, said separate pieces 710-1 to 710-N, once removed from the one or more enclosures 1400-1 to 1400-N, may be coupled together, in one or more various configurations, to assemble the second furniture object 200 externally to the first furniture object 100, thereby configuring the furniture set 10 to provide utility to a user based on the first and second furniture objects 100, 200 collectively providing utility to the user (e.g., a user sitting on the first furniture object 100 and resting one or more limbs and/or items on the second furniture object 200).

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

I claim:

1. A furniture set, comprising:

a first furniture object, the first furniture object including a load-bearing support assembly, the load-bearing support assembly configured to support a structural load, the load-bearing support assembly including a plurality of load-bearing beams, a seating assembly on the load-bearing support assembly, the seating assembly configured to receive the structural load such that the seating assembly conducts the structural load to the load-bearing support assembly, and a seal assembly on the load-bearing support assembly, the seal assembly including a partition structure configured to define a sealable aperture into an interior of the first furniture object; and a second furniture object, the second furniture object including a plurality of separate pieces configured to be detachably coupled to each other to assemble the second furniture object, wherein the load-bearing beams, the seating assembly, and the seal assembly collectively define a sealable enclosure within the interior of the first furniture object, such that the first furniture object is configured to hold the plurality of separate pieces within the sealable enclosure, and the partition structure is configured to detach from a remainder structure of the seal assembly to open the sealable aperture to enable removal of the plurality of separate pieces from the sealable enclosure through the opened aperture, wherein the plurality of load-bearing beams includes outer load-bearing beams that define side boundaries of the interior of the first furniture object and an inner load-bearing beam that divides the interior into two separate enclosures, the two separate enclosures including the sealable enclosure, such that the two separate enclosures are isolated from each other by the inner load-bearing beam such that the inner load-bearing beam at least partially defines a side boundary of each enclosure of the two separate enclosures, and at least one outer load-bearing beam of the outer load-bearing beams at least partially defines another side boundary of each enclosure of the two separate enclosures that is part of the side boundaries of the interior, wherein the seal assembly includes a single partition structure that is a single, continuous piece of material configured to open a single aperture to expose both of the two separate enclosures to an exterior of the first furniture object.

2. The furniture set of claim 1, wherein the seating assembly defines a top boundary of the sealable enclosure, and the seal assembly defines a bottom boundary of the sealable enclosure.

3. The furniture set of claim 1, wherein the first furniture object is a convertible sofa.

4. The furniture set of claim 1, wherein the plurality of separate pieces are configured to be coupled together in different configurations to assemble the second furniture object.

5. The furniture set of claim 1, wherein the partition structure is configured to expose the two separate enclosures based on detaching from the remainder structure of the seal assembly.

6. The furniture set of claim 1, wherein each enclosure of the two separate enclosures has a size that substantially matches a volume of a separate piece of the plurality of separate pieces, such that each separate piece occupies substantially an entirety of a separate enclosure of the two separate enclosures.

7. The furniture set of claim 1, wherein the partition structure is configured to reversibly detach from the remainder structure to reversibly open the sealable aperture.

8. The furniture set of claim 7, wherein the seal assembly includes a fastener assembly that is configured to reversibly detach the partition structure from the remainder structure.

9. A furniture set, comprising:

a first furniture object, the first furniture object including a load-bearing support assembly, the load-bearing support assembly configured to support a structural load, the load-bearing support assembly including a plurality of load-bearing beams, a seating assembly on the load-bearing support assembly, the seating assembly configured to receive the structural load such that the seating assembly conducts the structural load to the load-bearing support assembly, and a seal assembly on the load-bearing support assembly, the seal assembly including a partition structure configured to define a sealable aperture into an interior of the first furniture object; and a second furniture object, the second furniture object including a plurality of separate pieces configured to be detachably coupled to each other to assemble the second furniture object, wherein the load-bearing beams, the stating assembly, and the seal assembly collectively define a sealable enclosure within the interior of the first furniture object, such that the first furniture object is configured to hold the plurality of separate pieces within the sealable enclosure, and the partition structure is configured to detach from a remainder structure of the seal assembly to open the sealable aperture to enable removal of the plurality of separate pieces from the sealable enclosure through the opened aperture, wherein the plurality of load-bearing beams includes outer load-bearing beams that define side boundaries of the interior of the first furniture object and an inner load-bearing beam that divides the interior into two separate enclosures, the two separate enclosures including the sealable enclosure, such that the two separate enclosures are isolated from each other by the inner load-bearing beam such that the inner load-bearing beam at least partially defines a side boundary of each enclosure of the two separate enclosures, and at least one outer load-bearing beam of the outer load-bearing beams at least partially defines another side boundary of each enclosure of the two separate enclosures that is part of the side boundaries of the interior wherein the first furniture object is a convertible sofa, wherein the second furniture object is an ottoman.

10. The furniture set of claim 9, wherein the seal assembly includes a single partition structure that is a single, continuous piece of material configured to open a single aperture to expose both of the two separate enclosures to an exterior of the first furniture object.

11. A furniture object, comprising:

a load-bearing support assembly, the load-bearing support assembly configured to support a structural load, the load-bearing support assembly including a plurality of load-bearing beams;

a seating assembly on the load-bearing support assembly, the seating assembly configured to receive the structural load such that the seating assembly conducts the structural load to the load-bearing support assembly; and a seal assembly on the load-bearing support assembly, the seal assembly including a partition structure configured to define a sealable aperture into an interior of the furniture object, wherein the load-bearing beams, the seating assembly, and the seal assembly collectively define a sealable enclosure within the interior of the furniture object, such that the furniture object is configured to hold a plurality of separate pieces of a separate furniture object within the sealable enclosure, and the partition structure is configured to detach from a remainder structure of the seal assembly to open the sealable aperture to enable removal of the plurality of separate pieces from the sealable enclosure through the opened aperture, wherein the plurality of load-bearing beams includes outer load-bearing beams that define side boundaries of the interior of the furniture object and an inner load-bearing beam that divides the interior into two separate enclosures, the two separate enclosures including the sealable enclosure, such that the two separate enclosures are completely isolated from each other by the inner load-bearing beam such that the inner load-bearing beam at least partially defines a side boundary of each enclosure of the two separate enclosures, and at least one outer load-bearing beam of the outer load-bearing beams at least partially defines another side boundary of each enclosure of the two separate enclosures that is part of the side boundaries of the interior, wherein the seal assembly includes a single partition structure that is a single, continuous piece of material configured to open a single aperture to expose both of the two separate enclosures to an exterior of the furniture object.

12. The furniture object of claim 11, wherein the seating assembly defines a top boundary of the sealable enclosure, and the seal assembly defines a bottom boundary of the sealable enclosure.

13. The furniture object of claim 11, wherein the furniture object is a convertible sofa.

14. The furniture object of claim 13, wherein the separate furniture object is an ottoman.

15. The furniture object of claim 11, wherein the partition structure is configured to expose the two separate enclosures based on detaching from the remainder structure of the seal assembly.

16. The furniture object of claim 11, wherein each enclosure of the two separate enclosures has a size that substantially matches a volume of a separate piece of the plurality of separate pieces, such that each separate piece occupies substantially an entirety of a separate enclosure of the two separate enclosures.

17. The furniture object of claim 11, wherein the partition structure is configured to reversibly detach from the remainder structure to reversibly open the sealable aperture.

18. The furniture object of claim 17, wherein the seal assembly includes a fastener assembly that is configured to reversibly detach the partition structure from the remainder structure.

19. A method, comprising:

providing a first furniture object, the first furniture object including a load-bearing support assembly, the load-bearing support assembly configured to support a structural load, the load-bearing support assembly including a plurality of load-bearing beams;

a seating assembly on the load-bearing support assembly, the seating assembly configured to receive the structural load such that the seating assembly conducts the structural load to the load-bearing support assembly; and a seal assembly on the load-bearing support assembly, the seal assembly including a partition structure configured to define a sealable aperture into an interior of the first furniture object, wherein the load-bearing beams, the seating assembly, and the seal assembly collectively define a sealable enclosure within the interior of the first furniture object, a plurality of separate pieces of a second furniture object located within the sealable enclosure;

detaching the partition structure from a remainder structure of the seal assembly to open the sealable aperture to expose the sealable enclosure to an exterior of the first furniture object;

removing the plurality of separate pieces from the sealable enclosure via the opened aperture; and coupling the plurality of separate pieces together to assemble the second furniture object, wherein the plurality of load-bearing beams includes outer load-bearing beams that define side boundaries of the interior of the first furniture object and an inner load-bearing beam that divides the interior into two separate enclosures, the two separate enclosures including the sealable enclosure, such that the two separate enclosures are isolated from each other by the inner load-bearing beam such that the inner load-bearing beam at least partially defines a side boundary of each enclosure of the two separate enclosures, and at least one outer load-bearing beam of the outer load-bearing beams at least partially defines another side boundary of each enclosure of the two separate enclosures that is part of the side boundaries of the interior, wherein the seal assembly includes a single partition structure that is a single, continuous piece of material configured to open a single aperture to expose both of the two separate enclosures to the exterior of the first furniture object.

20. The method of claim 19, wherein the seating assembly defines a top boundary of the sealable enclosure, and the seal assembly defines a bottom boundary of the sealable enclosure.

21. The method of claim 19, wherein the first furniture object is a convertible sofa.

22. The method of claim 19, wherein the plurality of separate pieces are configured to be assembled in different configurations to assemble the second furniture object.

23. The method of claim 19, wherein the partition structure is configured to expose the two separate enclosures based on detaching from the remainder structure of the seal assembly.

24. The method of claim 19, wherein each enclosure of the two separate enclosures has a size that substantially matches a volume of a separate piece of the plurality of separate pieces, such that each separate piece occupies substantially an entirety of a separate enclosure of the two separate enclosures.

25. The method of claim 19, wherein the detaching the partition structure from the remainder structure of the seal assembly reversibly detaches the partition structure from the remainder structure to reversibly open the sealable aperture.

26. The method of claim 25, wherein the seal assembly includes a fastener assembly that is configured to reversibly detach the partition structure from the remainder structure.

27. A method, comprising:

providing a first furniture object, the first furniture object including a load-bearing support assembly, the load-bearing support assembly configured to support a structural load, the load-bearing support assembly including a plurality of load-bearing beams;

a seating assembly on the load-bearing support assembly, the seating assembly configured to receive the structural load such that the seating assembly conducts the structural load to the load-bearing support assembly; and a seal assembly on the load-bearing support assembly, the seal assembly including a partition structure configured to define a sealable aperture into an interior of the first furniture object, wherein the load-bearing beams, the seating assembly, and the seal assembly collectively define a sealable enclosure within the interior of the first furniture object, a plurality of separate pieces of a second furniture object located within the sealable enclosure;

detaching the partition structure from a remainder structure of the seal assembly to open the sealable aperture to expose the sealable enclosure to an exterior of the first furniture object;

removing the plurality of separate pieces from the sealable enclosure via the opened aperture; and coupling the plurality of separate pieces together to assemble the second furniture object, wherein the plurality of load-bearing beams includes outer load-bearing beams that define side boundaries of the interior of the first furniture object and an inner load-bearing beam that divides the interior into two separate enclosures, the two separate enclosures including the sealable enclosure, such that the two separate enclosures are isolated from each other by the inner load-bearing beam such that the inner load-bearing beam at least partially defines a side boundary of each enclosure of the two separate enclosures, and at least one outer load-bearing beam of the outer load-bearing beams at least partially defines another side boundary of each enclosure of the two separate enclosures that is part of the side boundaries of the interior, wherein the first furniture object is a convertible sofa, wherein the second furniture object is an ottoman.

28. The method of claim 27, wherein the seal assembly includes a single partition structure that is a single, continuous piece of material configured to open a single aperture to expose both of the two separate enclosures to the exterior of the first furniture object.

* * * * *